US009211693B2

(12) United States Patent
Inoue

(10) Patent No.: US 9,211,693 B2
(45) Date of Patent: Dec. 15, 2015

(54) STRIP-SHAPED BODY CUTTING POSITION ADJUSTMENT METHOD AND SYSTEM FOR CUTTING APPARATUS

(75) Inventor: Hiroshi Inoue, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 429 days.

(21) Appl. No.: 13/433,682

(22) Filed: Mar. 29, 2012

(65) Prior Publication Data

US 2012/0248235 A1 Oct. 4, 2012

(30) Foreign Application Priority Data

Mar. 30, 2011 (JP) ..... 2011-074029

(51) Int. Cl.

| | |
|---|---|
| ***B41F 13/60*** | (2006.01) |
| ***B26D 7/26*** | (2006.01) |
| ***B26D 5/34*** | (2006.01) |
| ***B41F 33/00*** | (2006.01) |
| ***B65H 23/188*** | (2006.01) |
| *B65H 35/08* | (2006.01) |

(52) U.S. Cl.

CPC . *B41F 13/60* (2013.01); *B26D 5/34* (2013.01); *B26D 7/2614* (2013.01); *B26D 7/2628* (2013.01); *B41F 33/0081* (2013.01); *B65H 23/1882* (2013.01); *B41P 2213/90* (2013.01); *B65H 35/08* (2013.01); *B65H 2511/512* (2013.01); *B65H 2801/21* (2013.01); *Y10T 83/54* (2015.04); *Y10T 83/541* (2015.04); *Y10T 83/543* (2015.04)

(58) Field of Classification Search

CPC .. B65H 23/18; B65H 23/1806; B65H 23/182; B65H 23/188; B65H 23/1882; B65H 23/1888; B26D 5/30; B26D 5/32; B26D 5/34; B26D 7/2614; B26D 7/2628; B41F 13/60; B41F 33/008; B41F 33/0081

USPC ..... 83/367, 369, 368, 370, 236, 237, 298, 83/312, 313

See application file for complete search history.

(56) References Cited

U.S. PATENT DOCUMENTS

| | | | | |
|---|---|---|---|---|
| 3,370,496 | A * | 2/1968 | Erhardt | 83/297 |
| 3,510,036 | A * | 5/1970 | Lewis, Jr. et al. | 226/2 |
| 4,955,265 | A | 9/1990 | Nakagawa et al. | |
| 2001/0009090 | A1* | 7/2001 | Todd et al. | 53/64 |
| 2002/0088323 | A1* | 7/2002 | Hashigaya | 83/38 |
| 2003/0052148 | A1* | 3/2003 | Rajala et al. | 226/44 |

FOREIGN PATENT DOCUMENTS

| | | |
|---|---|---|
| JP | 62-56561 | 4/1987 |
| JP | 2003-326679 A | 11/2003 |

OTHER PUBLICATIONS

Extended European Search Report dated Aug. 2, 2012.

* cited by examiner

*Primary Examiner* — Kenneth E. Peterson
*Assistant Examiner* — Jennifer Swinney
(74) *Attorney, Agent, or Firm* — Birch, Stewart, Kolasch & Birch, LLP

(57) ABSTRACT

A printing press control device and a cut-off register control device forcibly move a compensator roller by a set moving amount each time a set time elapses during a period from the start of speed acceleration to the end of speed acceleration.

4 Claims, 24 Drawing Sheets

STRIP-SHAPED BODY CUTTING POSITION ADJUSTMENT METHOD AND SYSTEM FOR CUTTING APPARATUS

TECHNICAL FIELD

The present invention relates to a strip-shaped body cutting position adjustment method and system for a cutting apparatus such as a cut-off cylinder in a folder of a web rotary printing press.

BACKGROUND ART

In web rotary printing presses, a web is cut in a center position of a margin portion between printed images in a direction orthogonal to a web transport direction by a cut-off cylinder in a folding machine and thereafter folded and delivered as a signature. However, during an acceleration (hereinafter, termed as "speed acceleration") of a web rotary printing press, due to a change in stretch or tension or the like of the web, the position where the web is to be cut by the cut-off cylinder is shifted with respect to the positions of printed images on the web, and the web may not be cut in the center position of the margin portion in some cases. In such cases, the printed images may appear in shifted positions when the signature is opened, or the web may be cut in an image portion in the worst cases.

For this reason, a cut-off register control device has been conventionally provided for the web to be cut in an accurate position between images by the cut-off cylinder. Such a cut-off register control device is configured to allow the web to be always cut in an accurate position by the following manner. The cut-off register control device prints a register mark in a margin portion at a lateral side of a position corresponding to an image on the web, simultaneously with the image, or uses a characteristic portion in a printed image as a register mark and then detects the register mark by a detector provided to an entrance of the folding machine (where the former is located). The cut-off register control device compares a rotation phase of the web rotary printing press when the register mark is actually detected with a reference rotation phase of the web rotary printing press for the web to be cut in a correct position and then adjusts the length of a transport path for the web by the amount corresponding to the gap by moving the position of a compensator roller provided upstream of the detector, the transport path extending to the position where the web enters the folding machine <refer to Patent Literature 1>.

CITATION LIST

Patent Literature

Patent Literature 1

Japanese Patent Application Publication No. 2003-326679

SUMMARY OF INVENTION

Technical Problem

With the conventional cut-off register control device, however, there is a time lag until the detector can detect the register mark again in a state where the correction made by the compensator roller is reflected. This is because the position of the compensator roller in the transport path for the web is apart from the position of the detector configured to detect the register mark in the transport path for the web. In addition, the tension of the web changes because the compensator roller is moved while the web is transported. To put it specifically, the web is additionally pulled by the amount corresponding to the moving amount of the compensation roller when the transport path for the web is increased, while the web goes slack by the amount corresponding to the moving amount of the compensation roller when the transport path for the web is reduced.

Because of the reasons mentioned above, the position between images on the web where the web is to be cut by the cut-off cylinder becomes unstable. Thus, when detection and adjustment is made once, the next detection and adjustment has to wait until the tension of the web becomes stable, and the cutting position of the web is shifted in the meanwhile. Accordingly, there arises a problem that a large amount of waste paper is generated because it takes a while until the web becomes ready to be cut in an accurate position through adjustment by the cut-off register control device.

In this respect, an object of the present invention is to solve the aforementioned problem by allowing setting and storing of a wait time and a moving amount of the compensator roller in accordance with a paper quality, then, adjusting the position of the compensator roller by a larger amount taking into account the time lag by forcibly moving the compensator roller by the set moving amount each time the set time elapses during a period from the start of speed acceleration until the end of speed acceleration, and thus causing the web to be cut in an accurate position ahead of time.

Solution to Problem

A strip-shaped body cutting position adjustment method for a cutting apparatus, according to the present invention for solving the aforementioned problem is used in a system comprising: a strip-shaped body feeding apparatus configured to feed a strip-shaped body; a cutting apparatus configured to cut the fed strip-shaped body; a compensator roller which is provided in a strip-shaped body transport path extending from the strip-shaped body feeding apparatus to the cutting apparatus and which is supported movably for changing a length of the strip-shaped body transport path extending from the strip-shaped body feeding apparatus to the cutting apparatus; a register mark printed on the strip-shaped body; and a detector which is provided in such a manner as to face the strip-shaped body transported from the compensator roller to the cutting apparatus, and which is configured to detect the register mark, the method comprising the steps of: finding a rotation phase of the cutting apparatus when the detector detects the register mark; finding a rotation phase difference by comparing the found rotation phase of the cutting apparatus at the time of detection of the register mark with a previously stored reference rotation phase; and moving the compensator roller in accordance with the found rotation phase difference, the system further comprising: first storage means for storing a first reference elapsed time from start of speed acceleration of the cutting apparatus at which movement of the compensator roller is started; second storage means for storing a first moving amount of the compensator roller; and elapsed time measurement means for measuring time from the start of speed acceleration of the cutting apparatus, the method further comprising the steps of: comparing the elapsed time measured by the elapsed time measurement means with the first reference elapsed time stored in the first storage means; and moving the compensator roller by the first moving amount stored in the second storage means, when the elapsed time measured by the elapsed time measurement means becomes equal to the first reference elapsed time.

In addition, the strip-shaped body cutting position adjustment method for a cutting apparatus is used in the system further comprising: third storage means for storing a second reference elapsed time from start of speed acceleration of the cutting apparatus at which movement of the compensator roller is started; and fourth storage means for storing a second moving amount of the compensator roller, and the method further comprising the steps of: comparing the elapsed time measured by the elapsed time measurement means with the second reference elapsed time stored in the third storage means; and moving the compensator roller by the second moving amount stored in the fourth storage means, when the elapsed time measured by the elapsed time measurement means becomes equal to the second reference elapsed time.

A strip-shaped body cutting position adjustment system for a cutting apparatus, according to the present invention for solving the aforementioned problem comprises: a strip-shaped body feeding apparatus configured to feed a strip-shaped body; a cutting apparatus configured to cut the fed strip-shaped body; a compensator roller which is provided in a strip-shaped body transport path extending from the strip-shaped body feeding apparatus to the cutting apparatus and which is supported movably for changing a length of the strip-shaped body transport path extending from the strip-shaped body feeding apparatus to the cutting apparatus; a register mark printed on the strip-shaped body; a detector which is provided in such a manner as to face the strip-shaped body transported from the compensator roller to the cutting apparatus, and which is configured to detect the register mark; and a control unit configured to find a rotation phase of the cutting apparatus when the detector detects the register mark, then to find a rotation phase difference by comparing the found rotation phase of the cutting apparatus at the time of detection of the register mark with a previously stored reference rotation phase, and to move the compensator roller in accordance with the found rotation phase difference, and the system further comprises: first storage means for storing a first reference elapsed time from start of speed acceleration of the cutting apparatus at which movement of the compensator roller is started; second storage means for storing a first moving amount of the compensator roller; and elapsed time measurement means for measuring time from the start of speed acceleration of the cutting apparatus, wherein the control unit compares the elapsed time measured by the elapsed time measurement means with the first reference elapsed time stored in the first storage means, and moves the compensator roller by the first moving amount stored in the second storage means, when the elapsed time measured by the elapsed time measurement means becomes equal to the first reference elapsed time.

In addition, the strip-shaped body cutting position adjustment system for a cutting apparatus, according to the present invention further comprises:

third storage means for storing a second reference elapsed time from start of speed acceleration of the cutting apparatus at which movement of the compensator roller is started; and fourth storage means for storing a second moving amount of the compensator roller, wherein the control unit compares the elapsed time measured by the elapsed time measurement means with the second reference elapsed time stored in the third storage means, and moves the compensator roller by the second moving amount stored in the fourth storage means, when the elapsed time measured by the elapsed time measurement means becomes equal to the second reference elapsed time.

Advantageous Effects of Invention

With the strip-shaped body cutting position adjustment method and system for a cutting apparatus according to the present invention, the compensator roller is configured to be forcibly moved by the set moving amount each time the set time elapses during a period from the start of speed acceleration until the end of speed acceleration. Thus, the position of the compensator roller can be adjusted by a larger amount taking into account a time lag. Thus, it is possible to achieve a reduction in the time required until the web becomes ready to be cut in an accurate position through adjustment by the cut-off register control device. Accordingly, it is made possible to suppress generation of waste paper.

DESCRIPTION OF EMBODIMENT

A detailed description will be given of a strip-shaped body cutting position adjustment method and system for a cutting apparatus according to the present invention below through an embodiment with reference to the drawings.

{Embodiment}

Figure 1A:
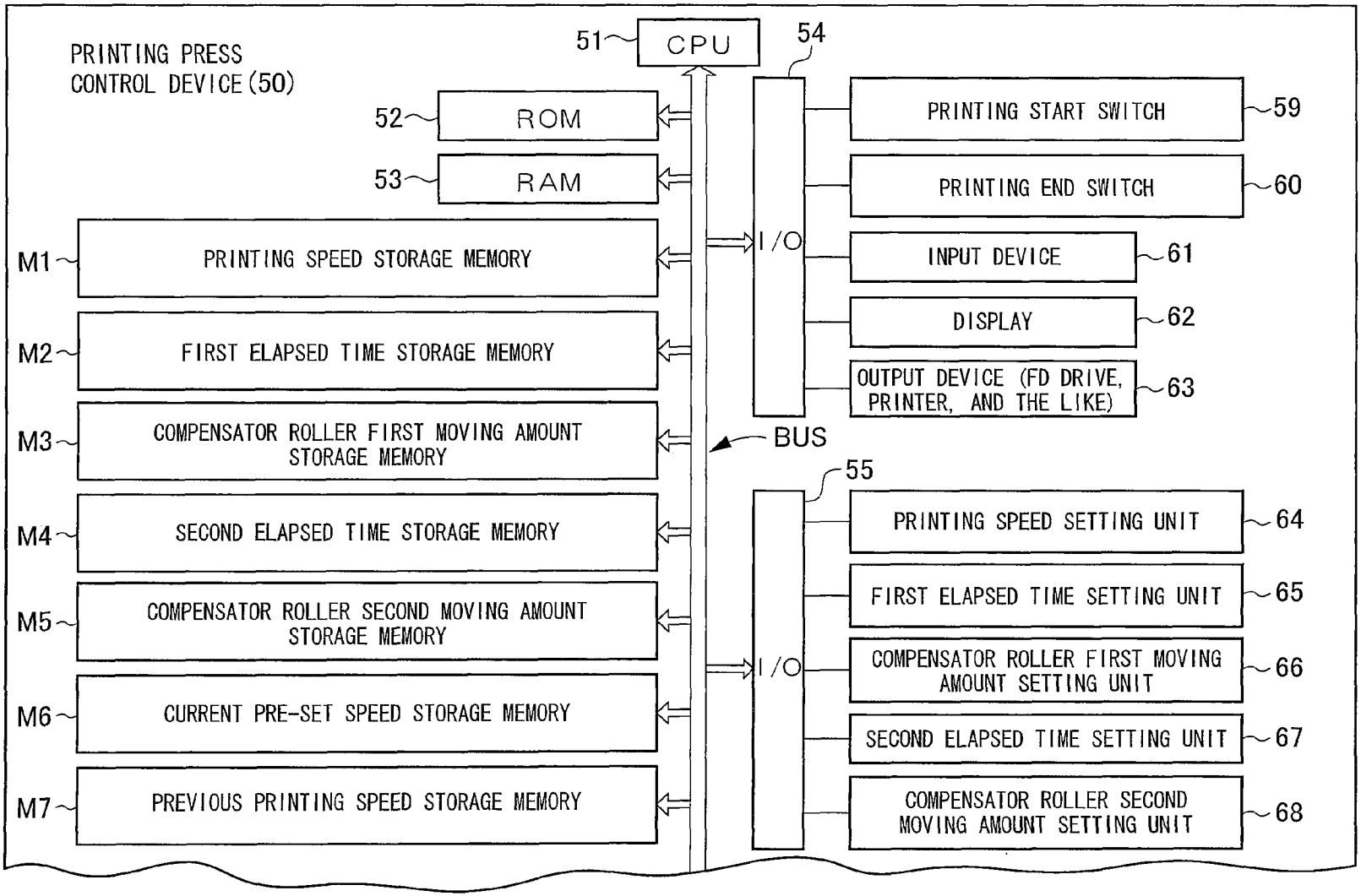
FIG. 1A is a block diagram of a printing press control device for illustrating an embodiment of the present invention.
Figure 1B:
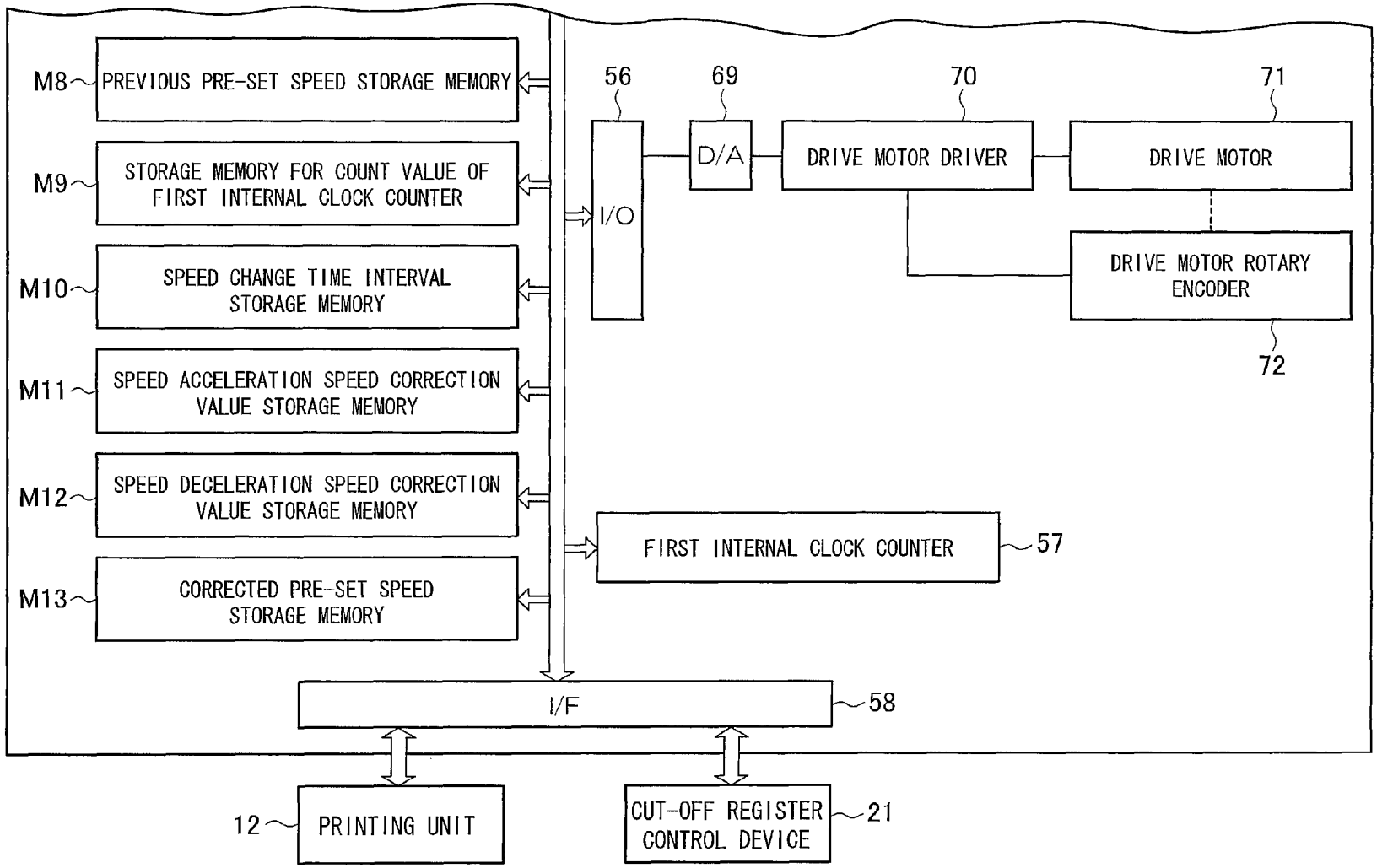
FIG. 1B is a block diagram of the same printing press control device.
Figure 2A:
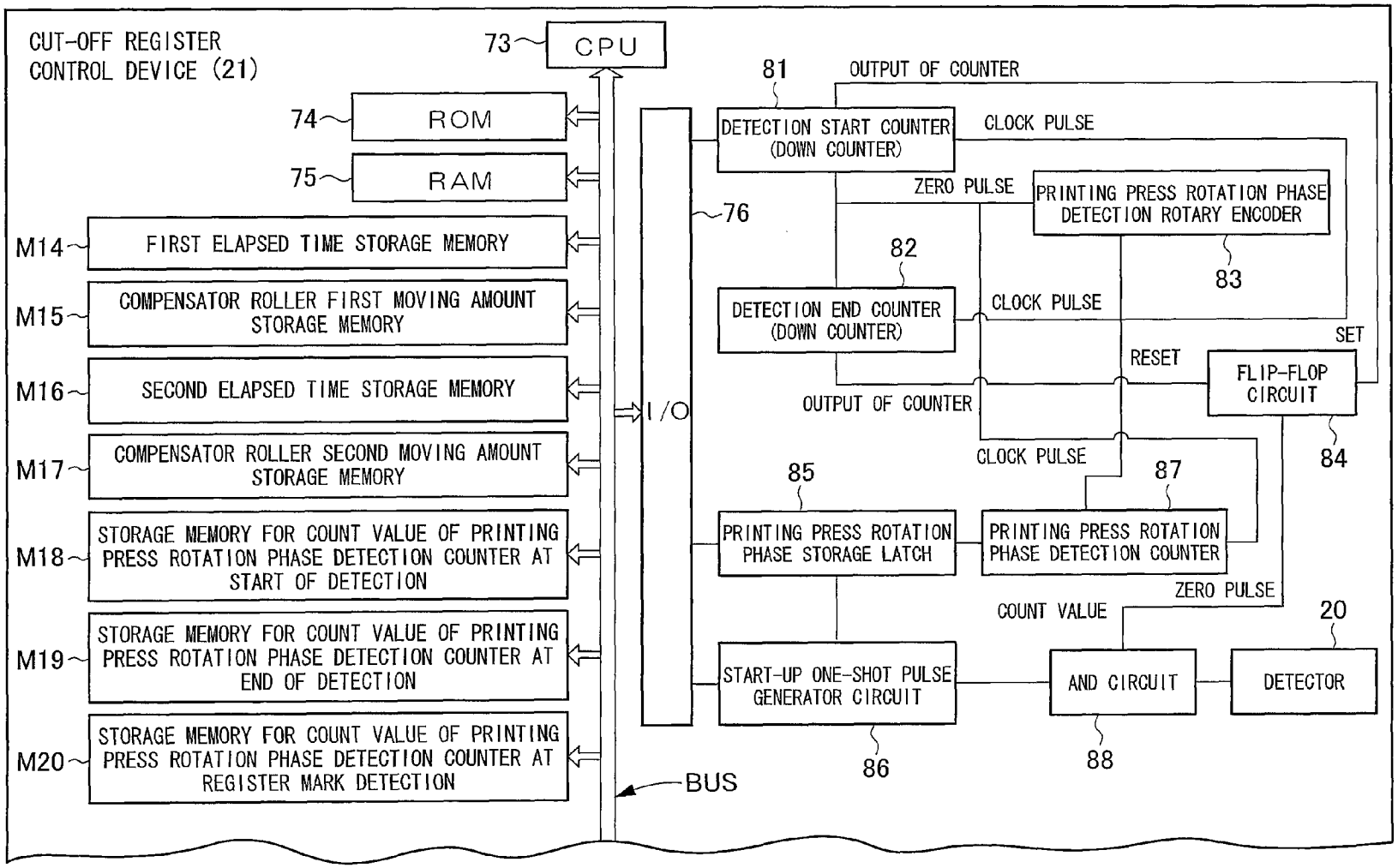
FIG. 2A is a block diagram of a cut-off register control device.
Figure 2B:
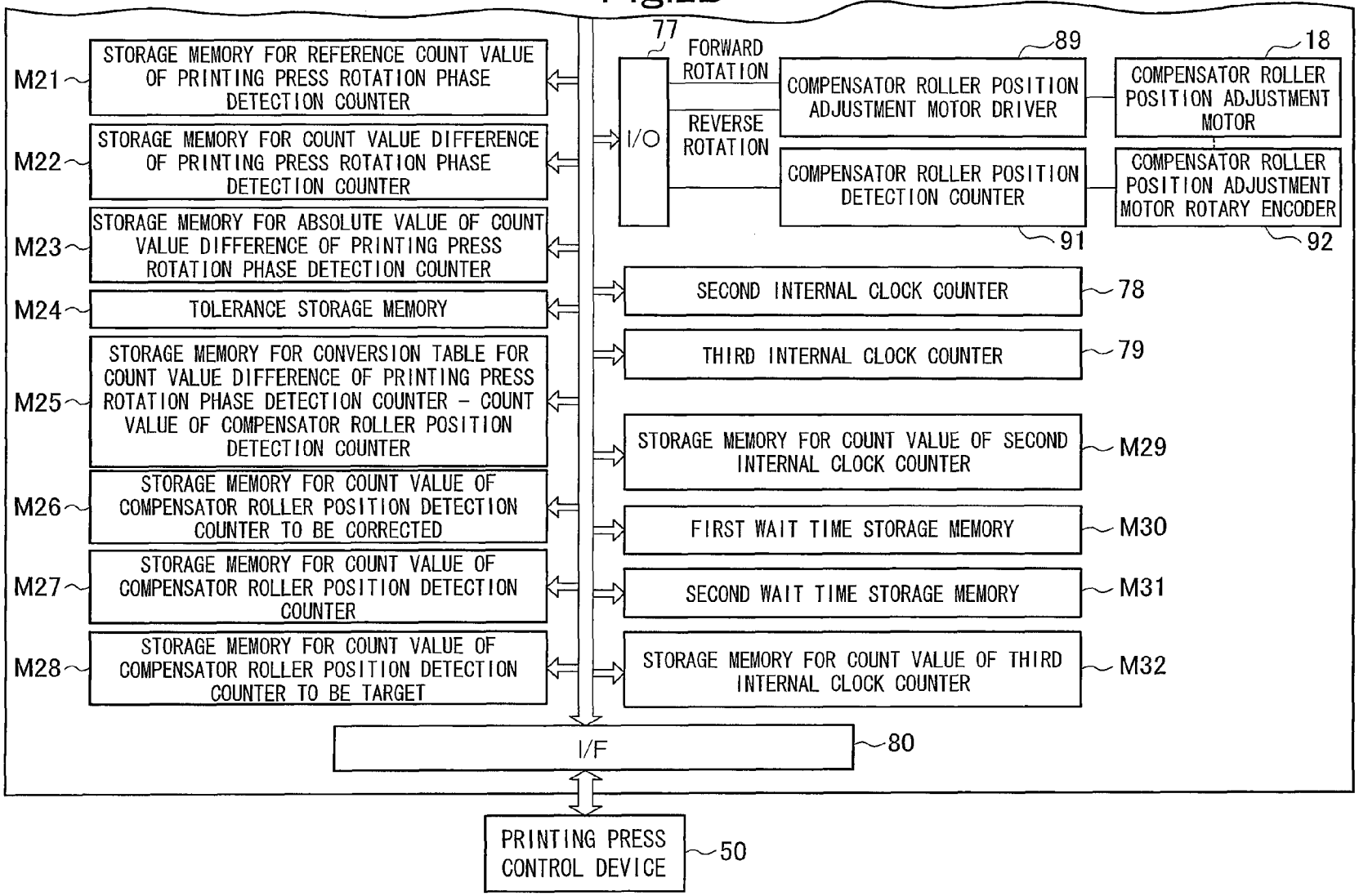
FIG. 2B is a block diagram of the cut-off register control device.
Figure 3A:
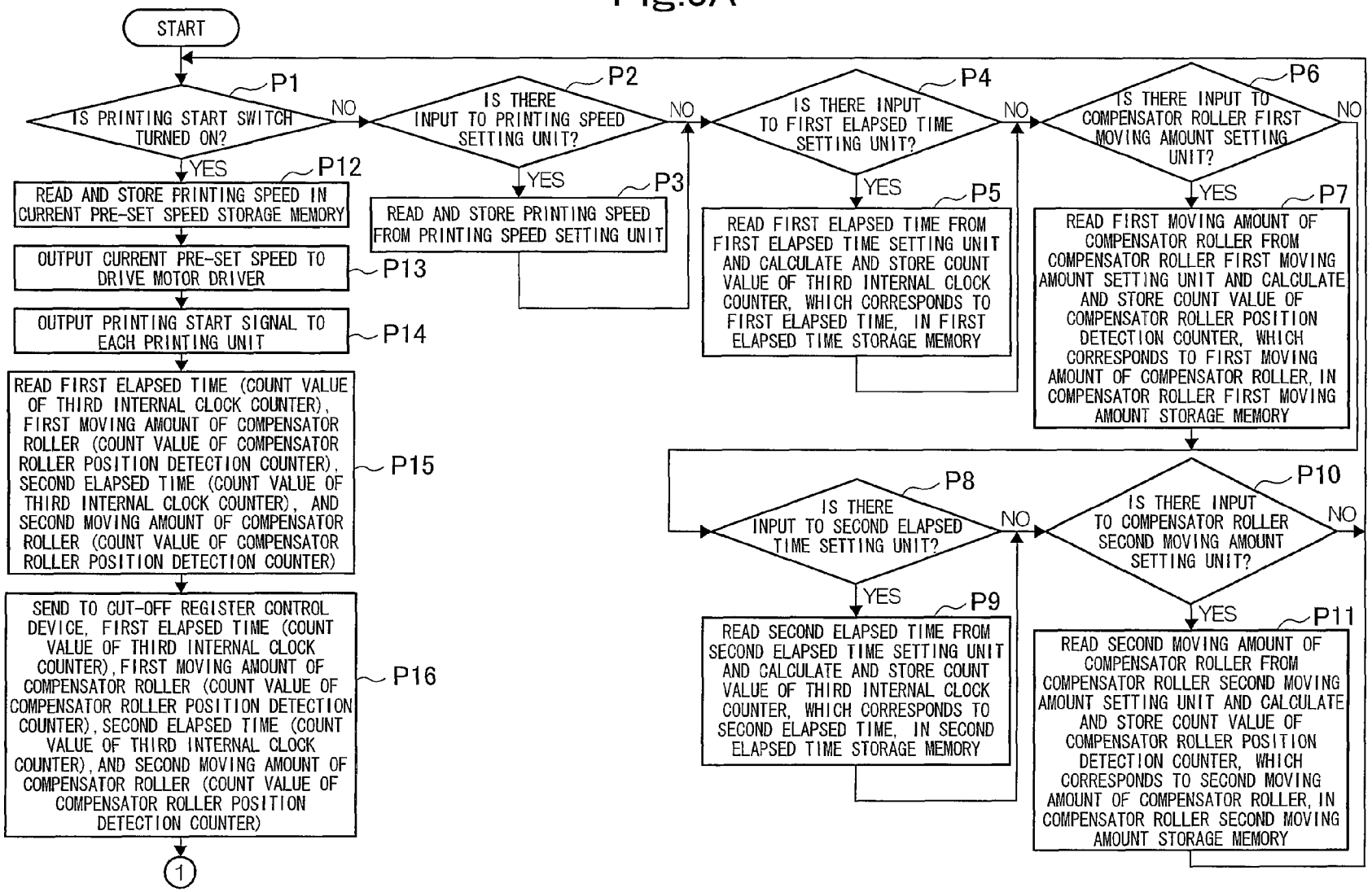
FIG. 3A is an operation flowchart of the printing press control device.
Figure 3B:
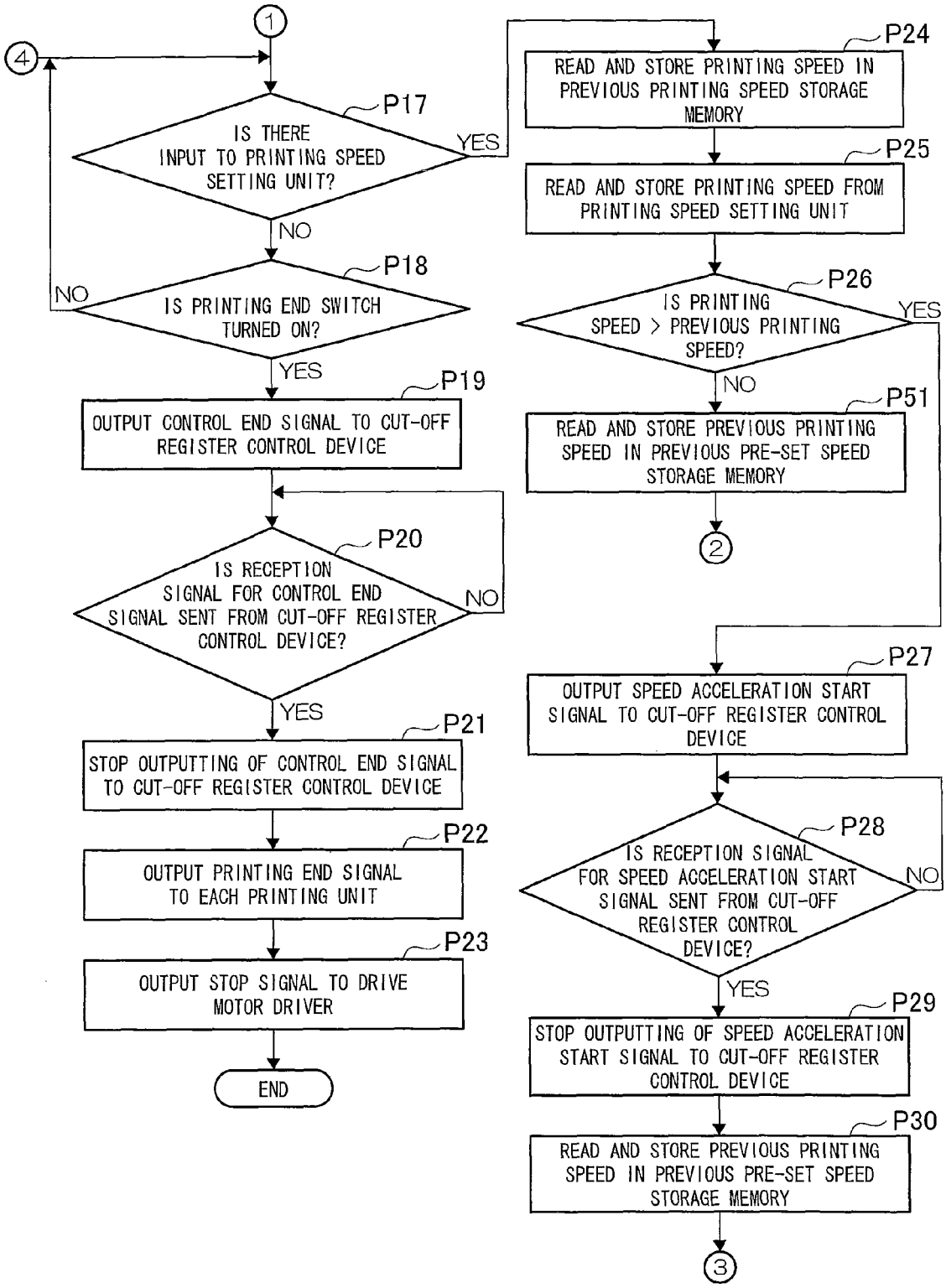
FIG. 3B is an operation flowchart of the printing press control device.
Figure 3C:
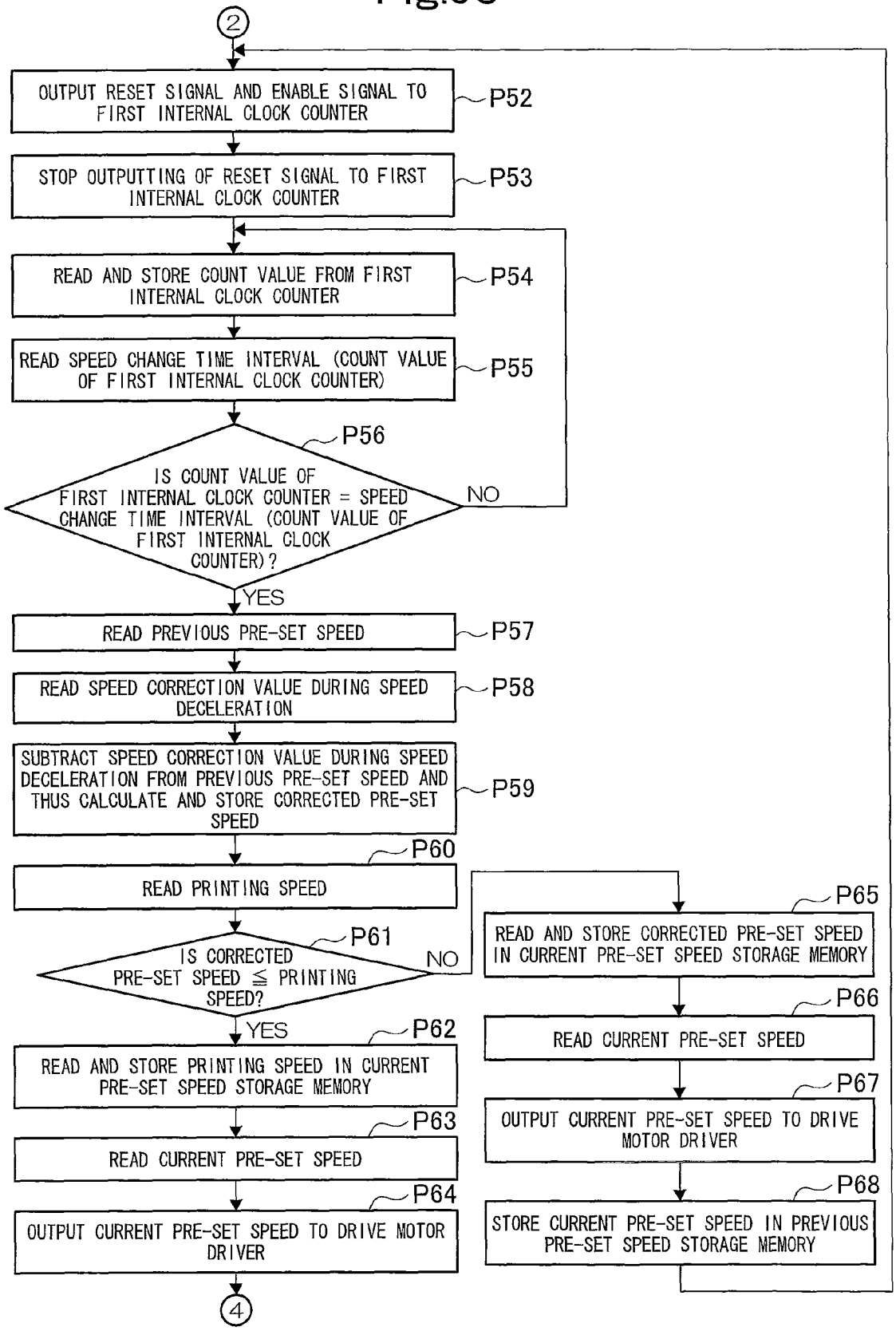
FIG. 3C is an operation flowchart of the printing press control device.
Figure 3D:
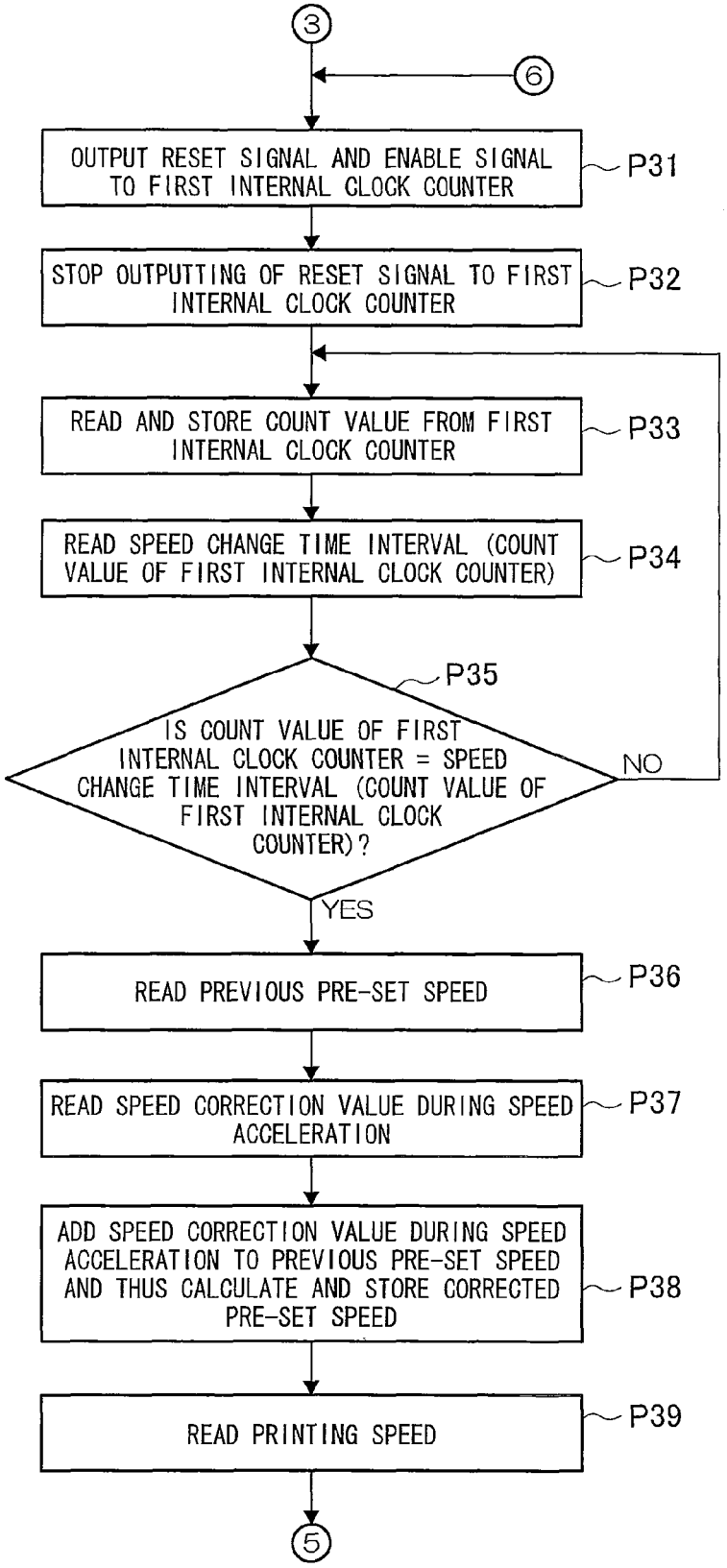
FIG. 3D is an operation flowchart of the printing press control device.
Figure 3E:
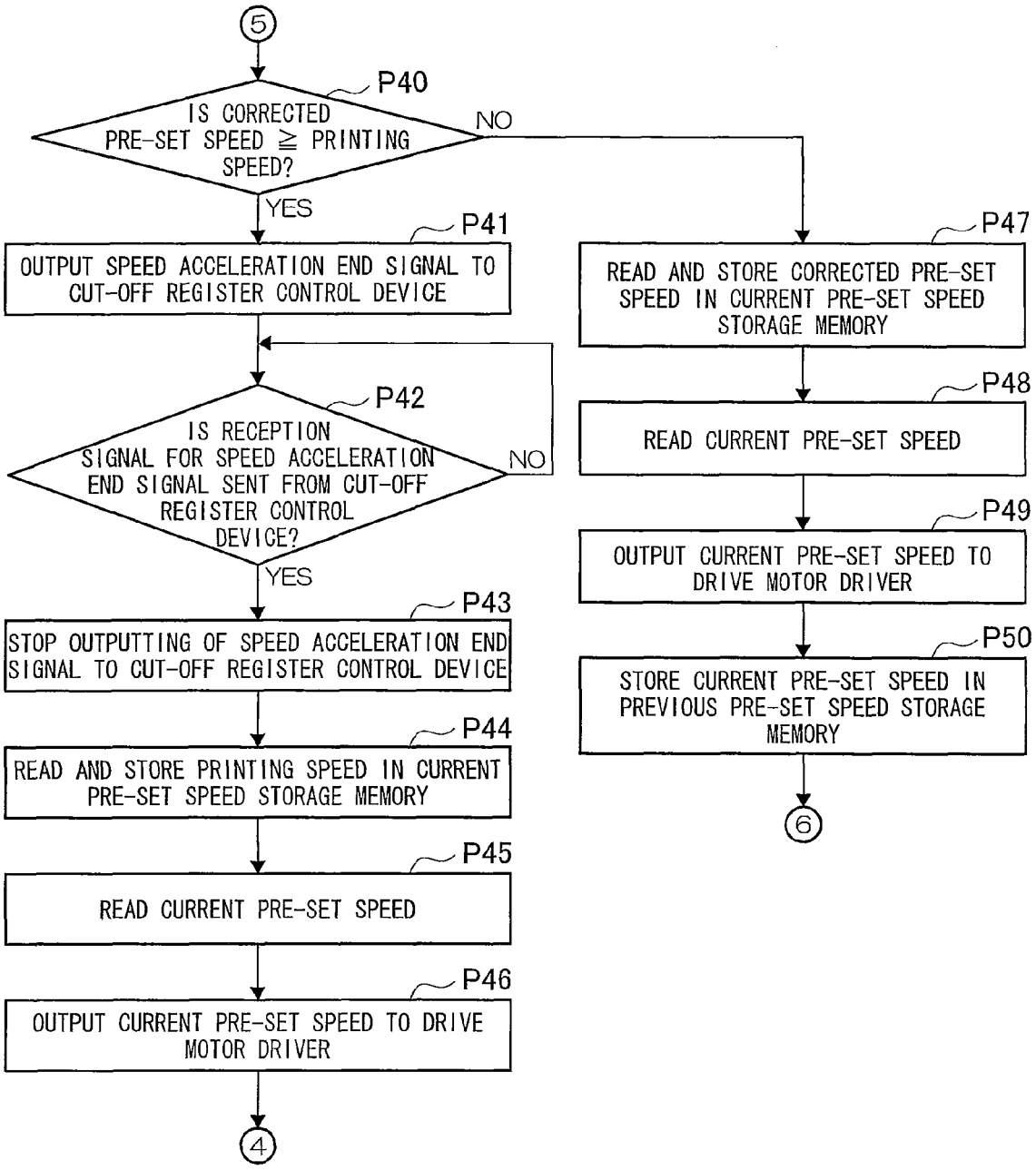
FIG. 3E is an operation flowchart of the printing press control device.
Figure 4A:
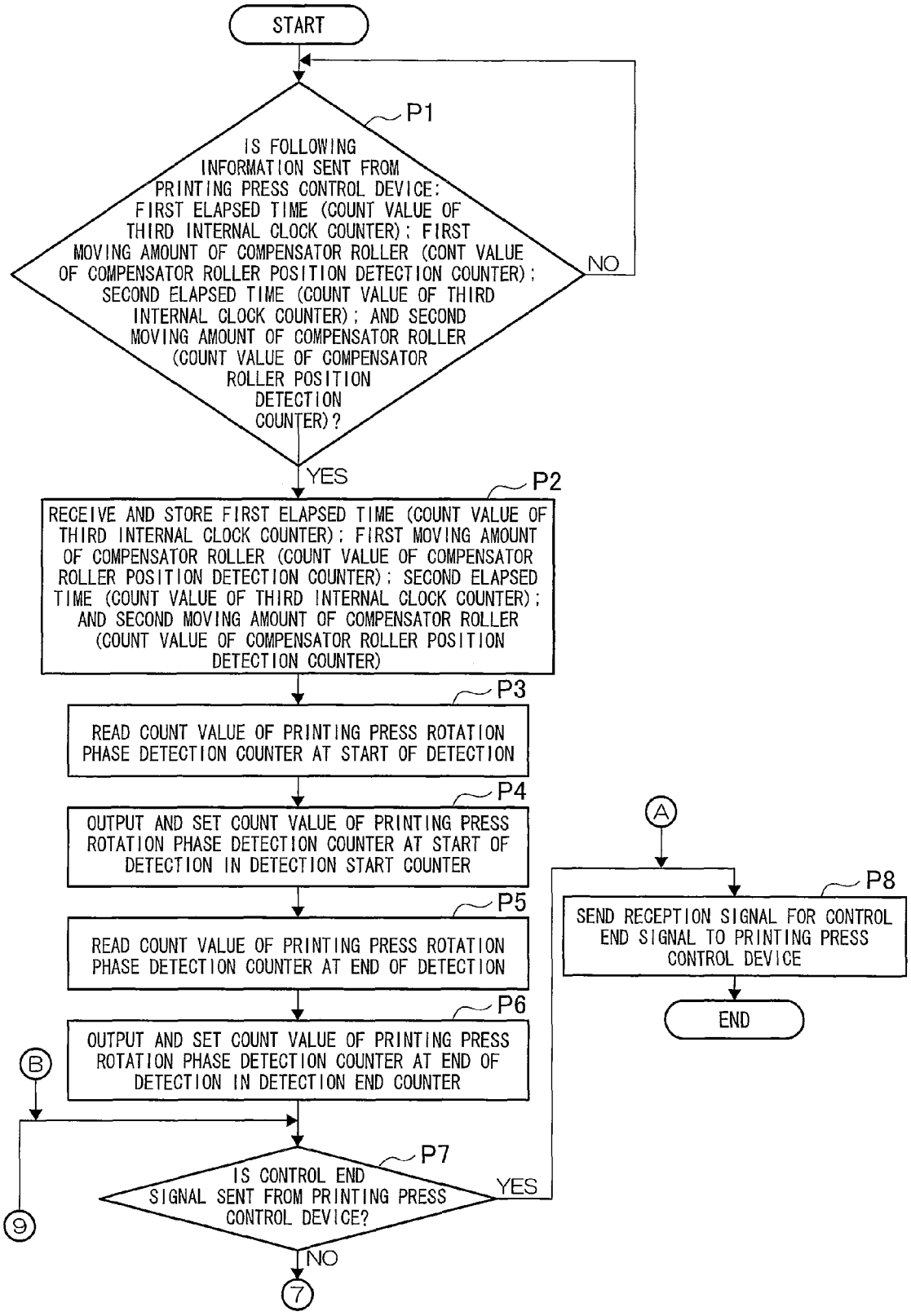
FIG. 4A is an operation flowchart of the cut-off register control device.
Figure 4B:
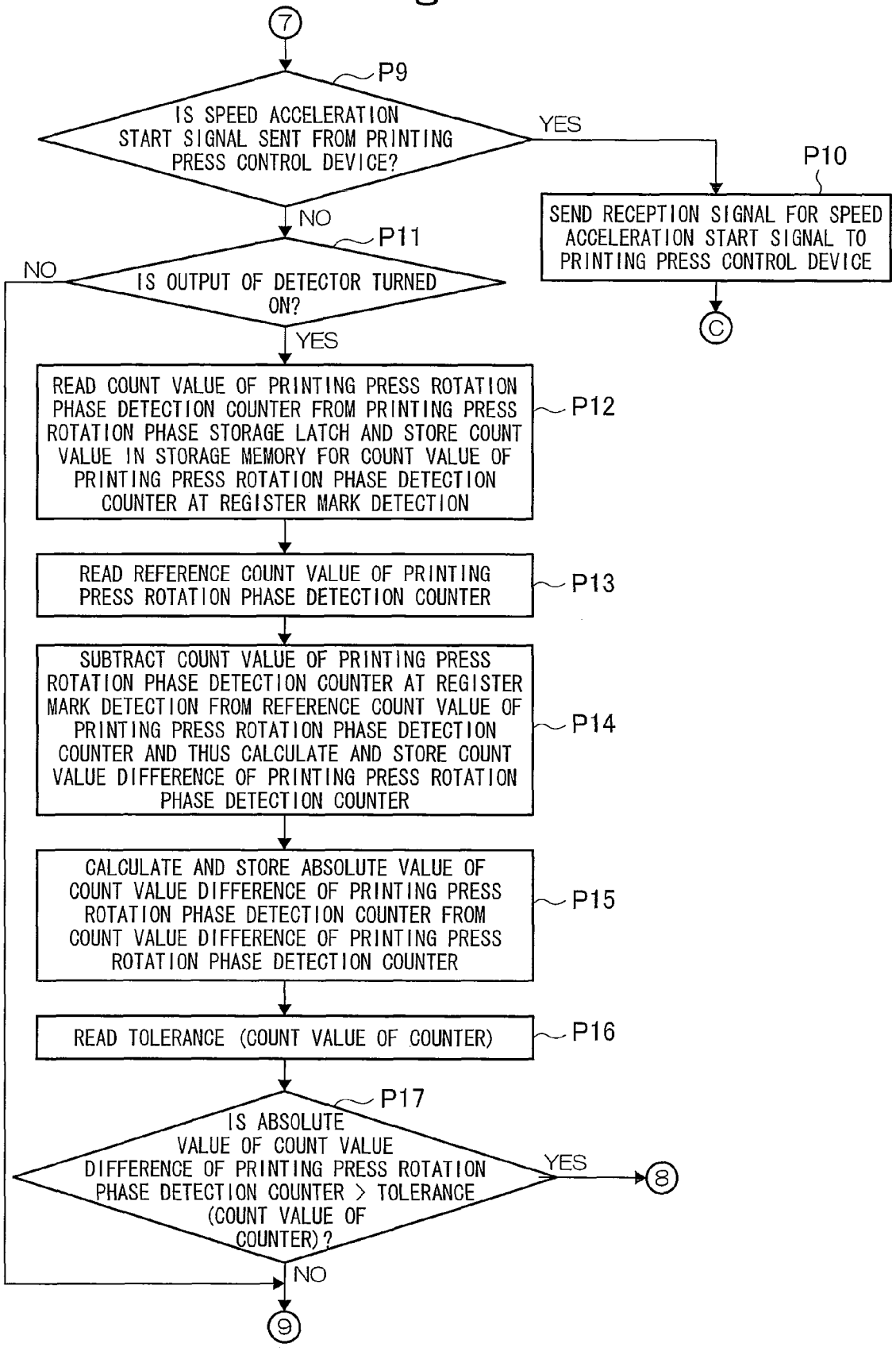
FIG. 4B is an operation flowchart of the cut-off register control device.
Figure 4C:
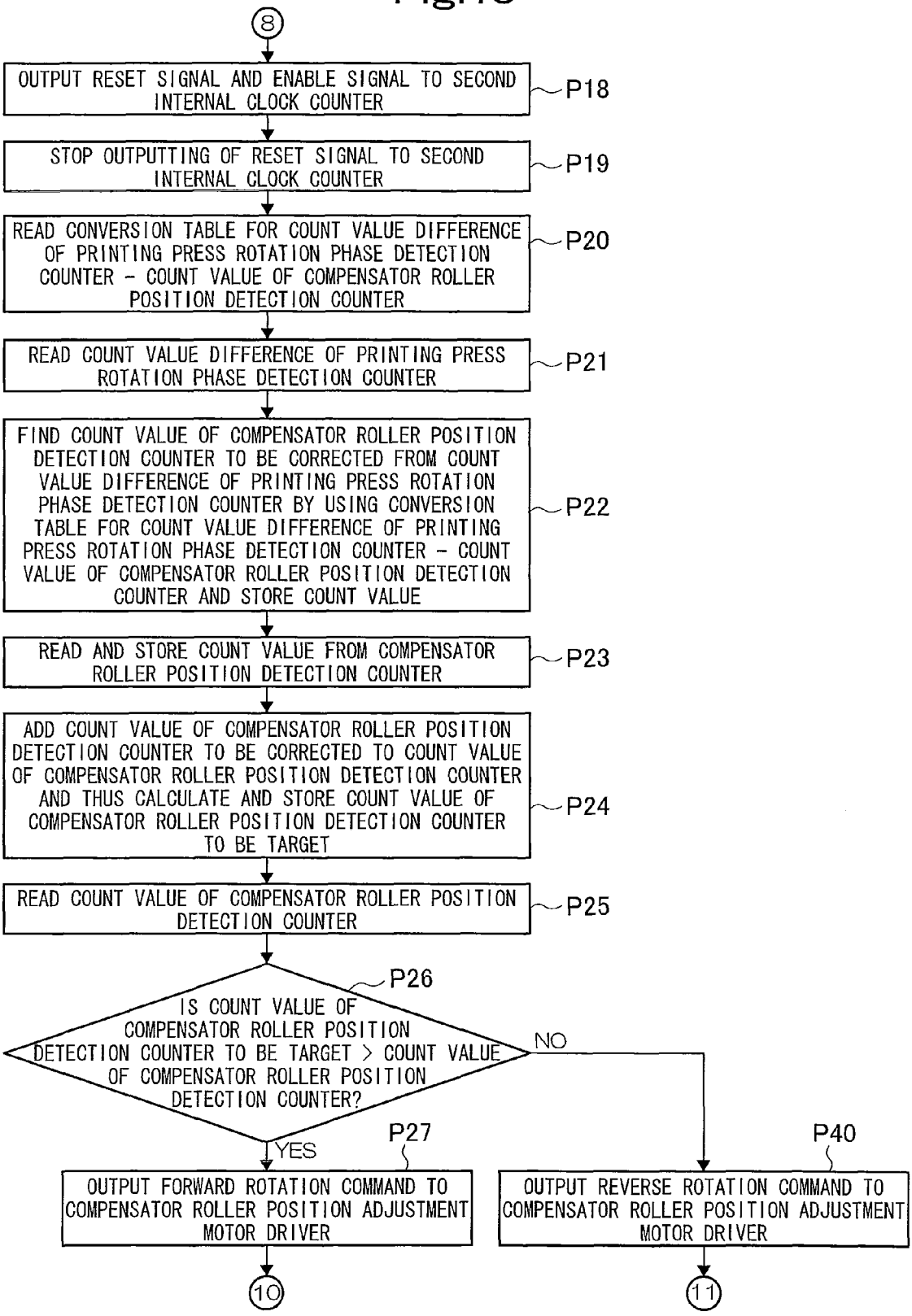
FIG. 4C is an operation flowchart of the cut-off register control device.
Figure 4D:
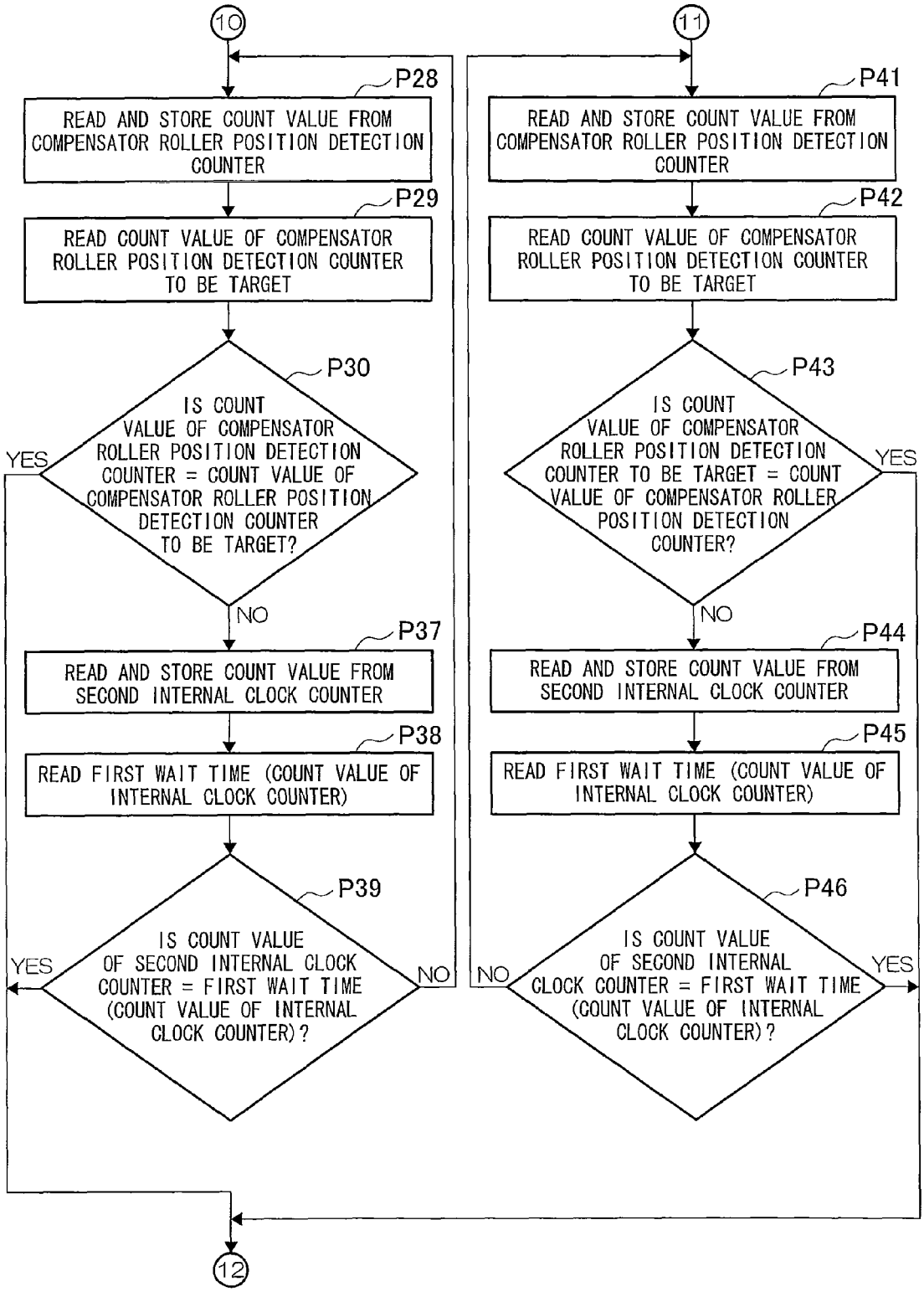
FIG. 4D is an operation flowchart of the cut-off register control device.
Figure 4E:
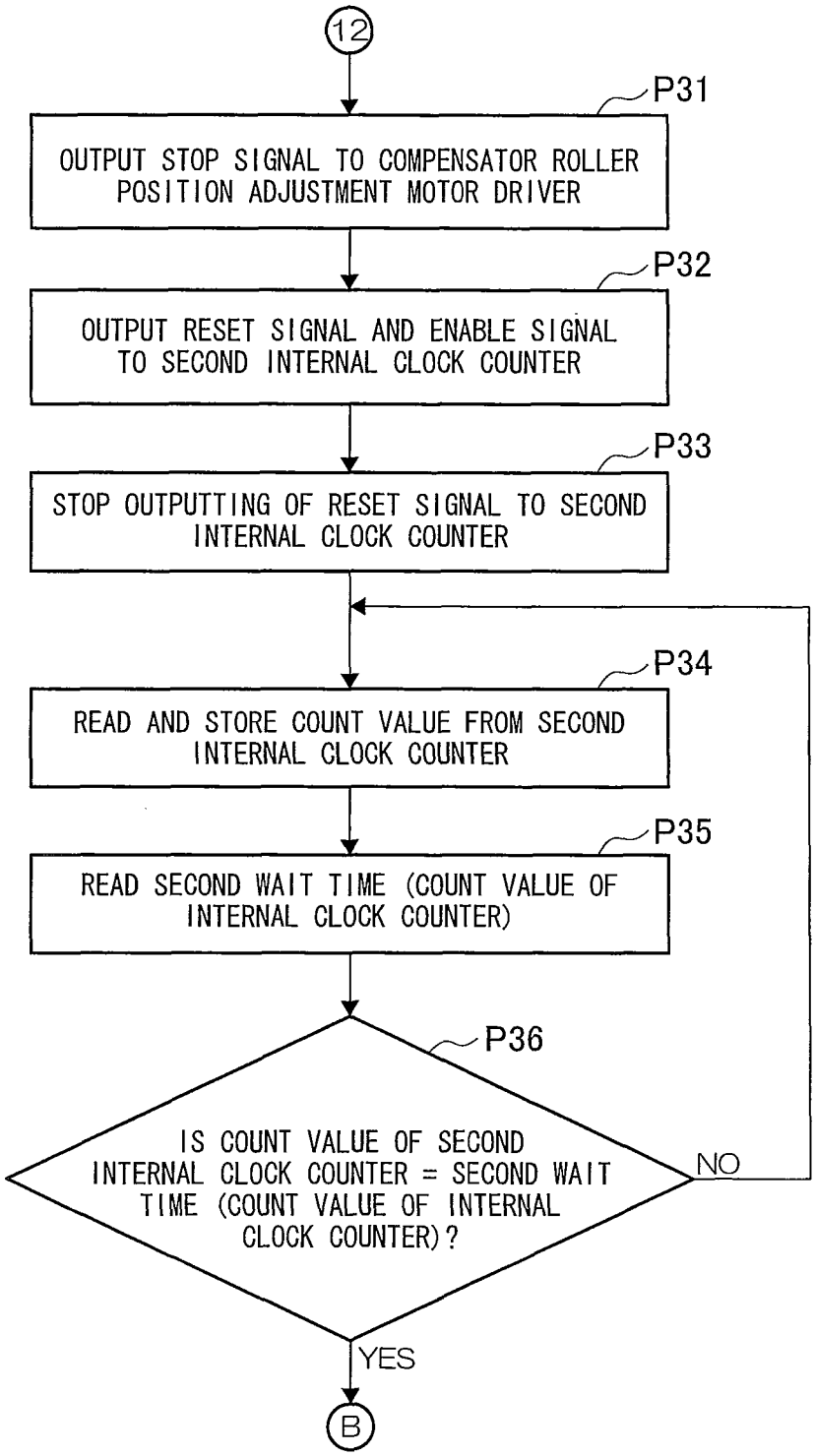
FIG. 4E is an operation flowchart of the cut-off register control device.
Figure 5A:
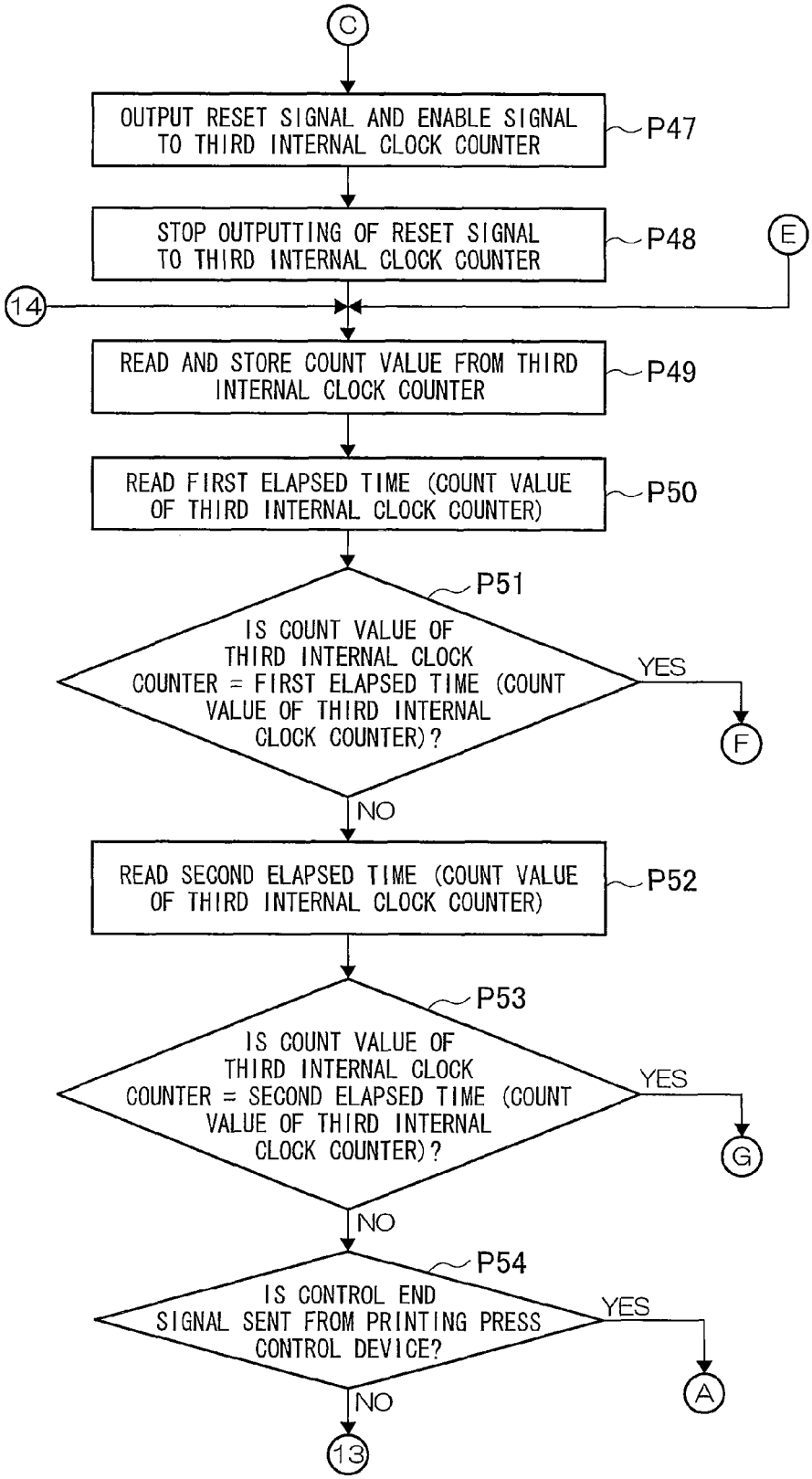
FIG. 5A is an operation flowchart of the cut-off register control device.
Figure 5B:
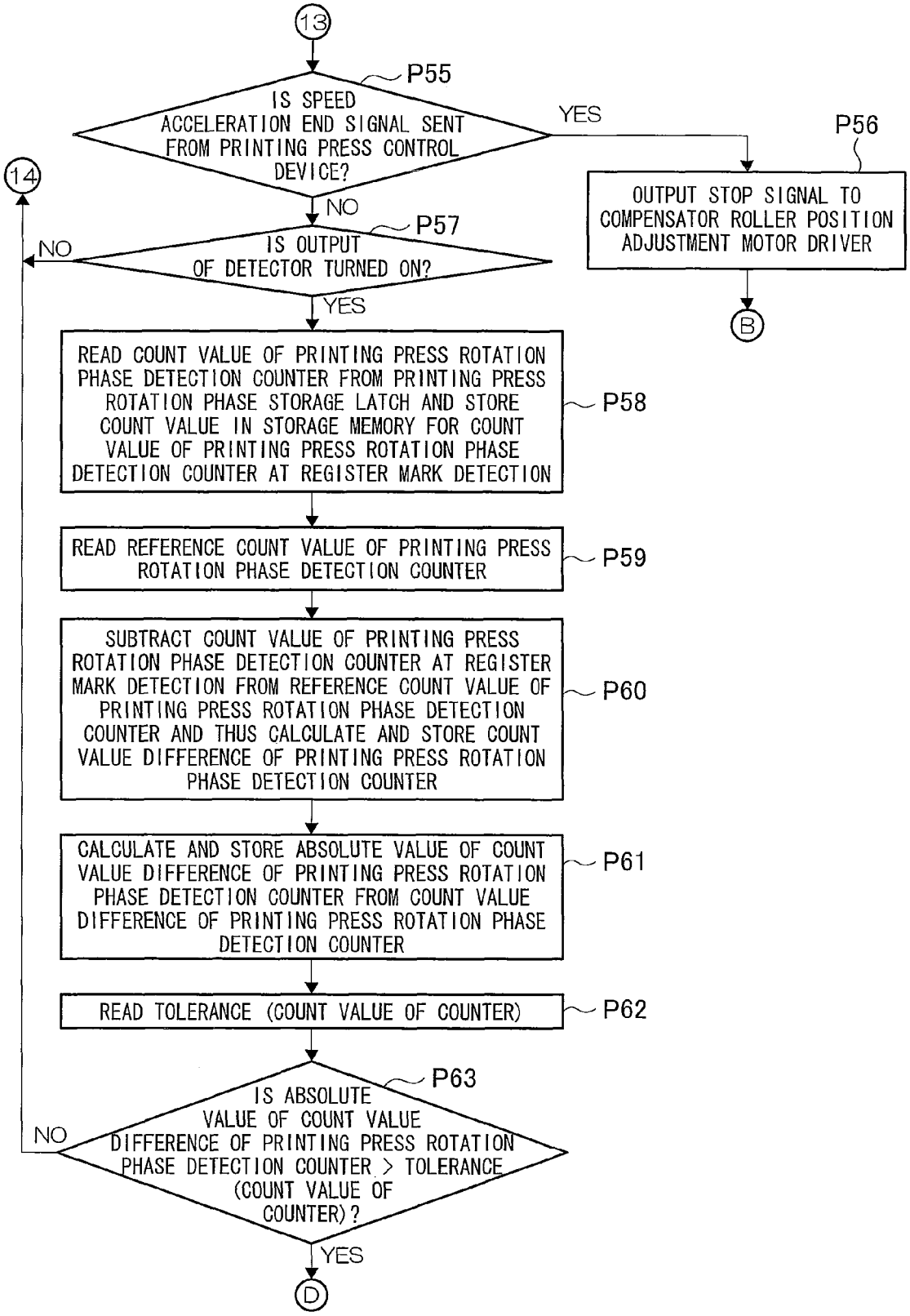
FIG. 5B is an operation flowchart of the cut-off register control device.
Figure 6A:
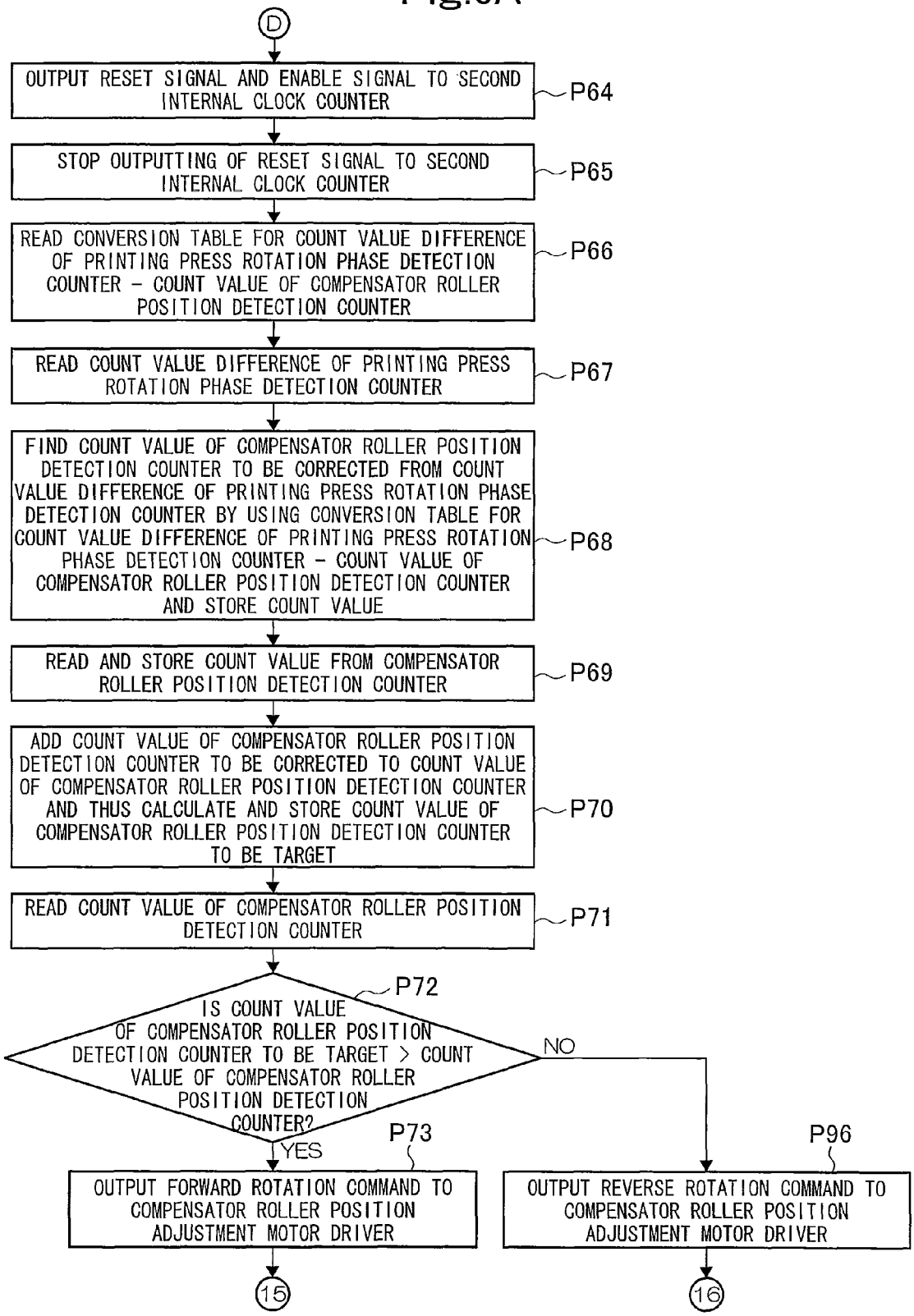
FIG. 6A is an operation flowchart of the cut-off register control device.
Figure 6B:
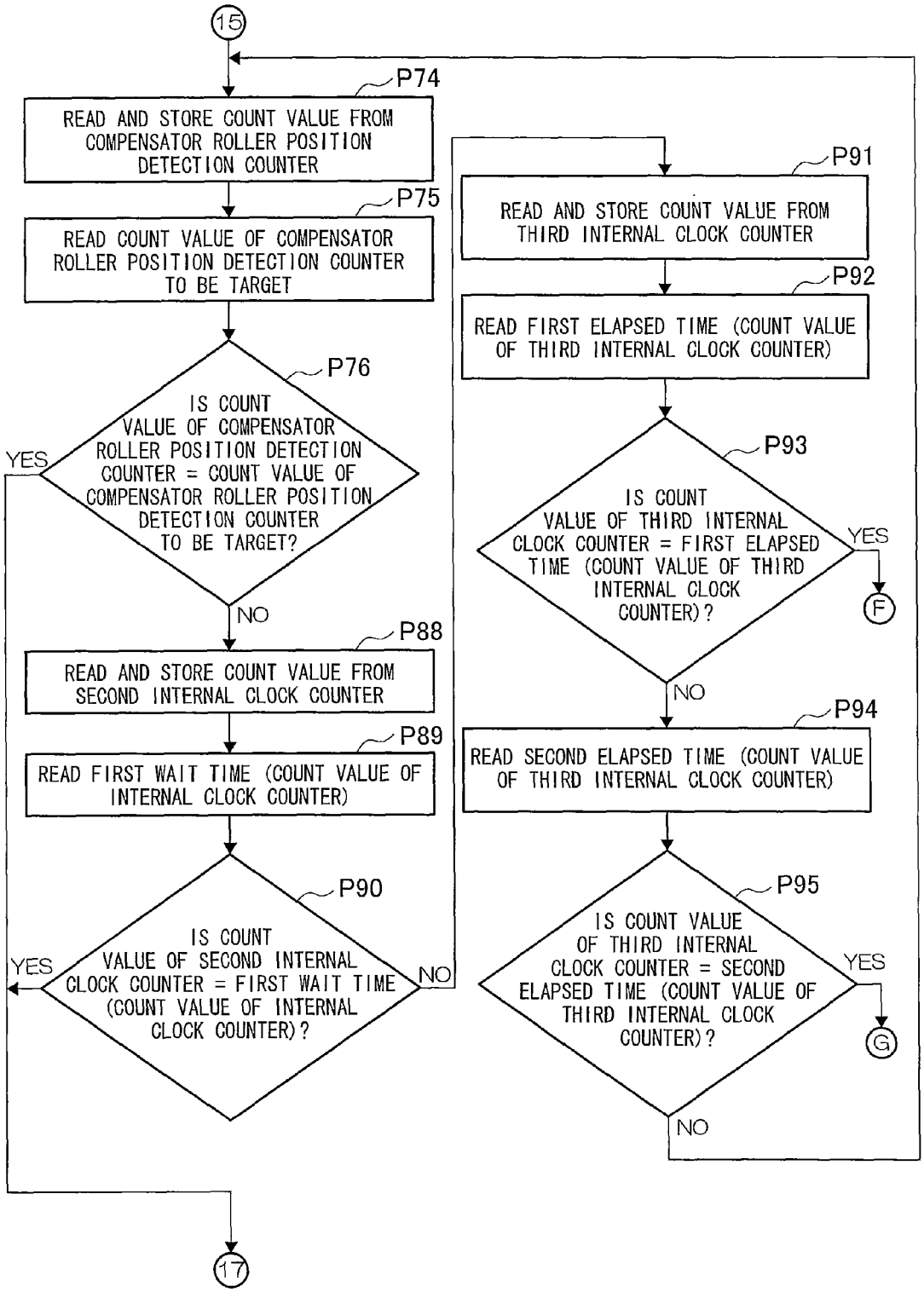
FIG. 6B is an operation flowchart of the cut-off register control device.
Figure 6C:
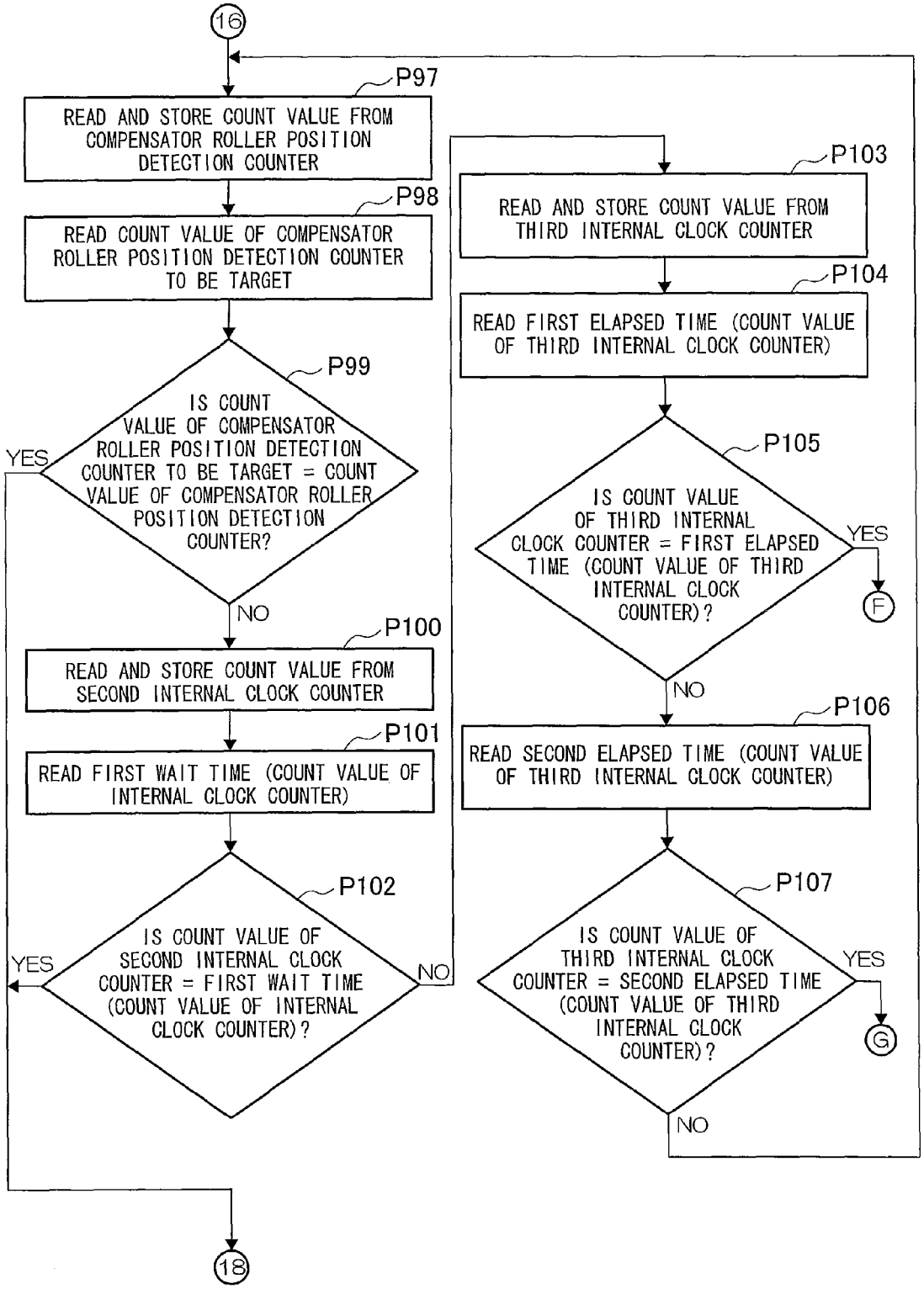
FIG. 6C is an operation flowchart of the cut-off register control device.
Figure 6D:
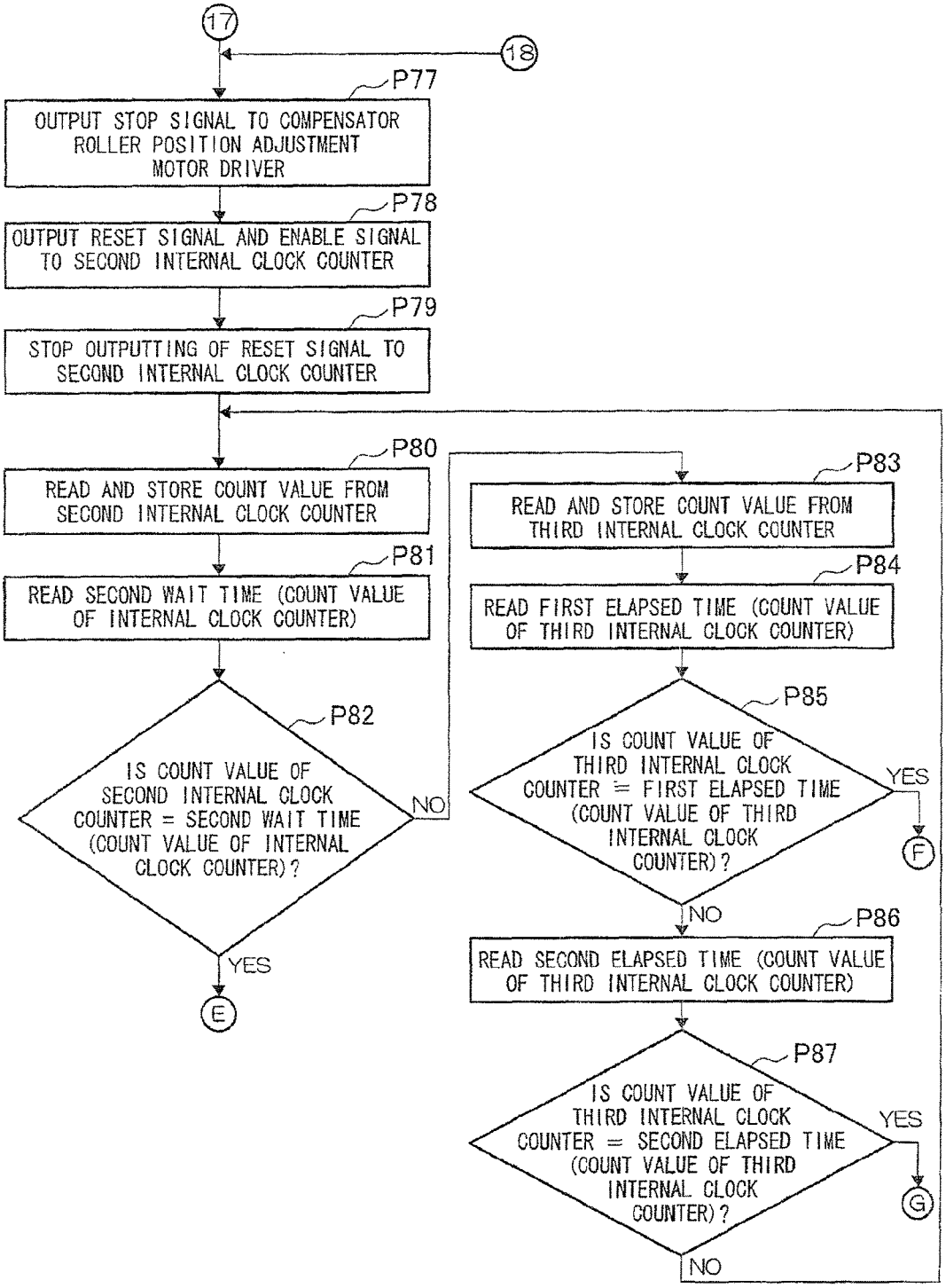
FIG. 6D is an operation flowchart of the cut-off register control device.
Figure 7A:
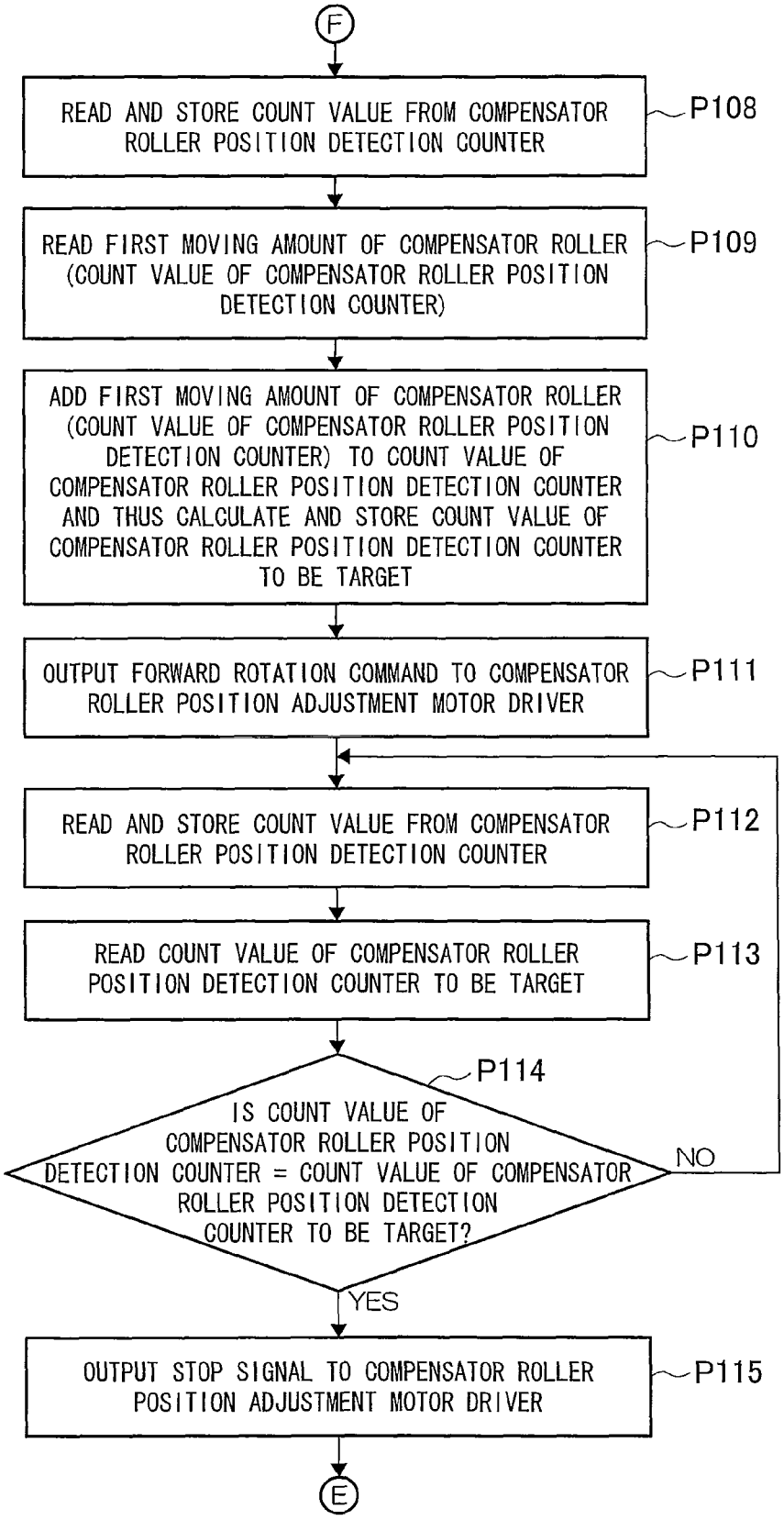
FIG. 7A is an operation flowchart of the cut-off register control device.
Figure 7B:
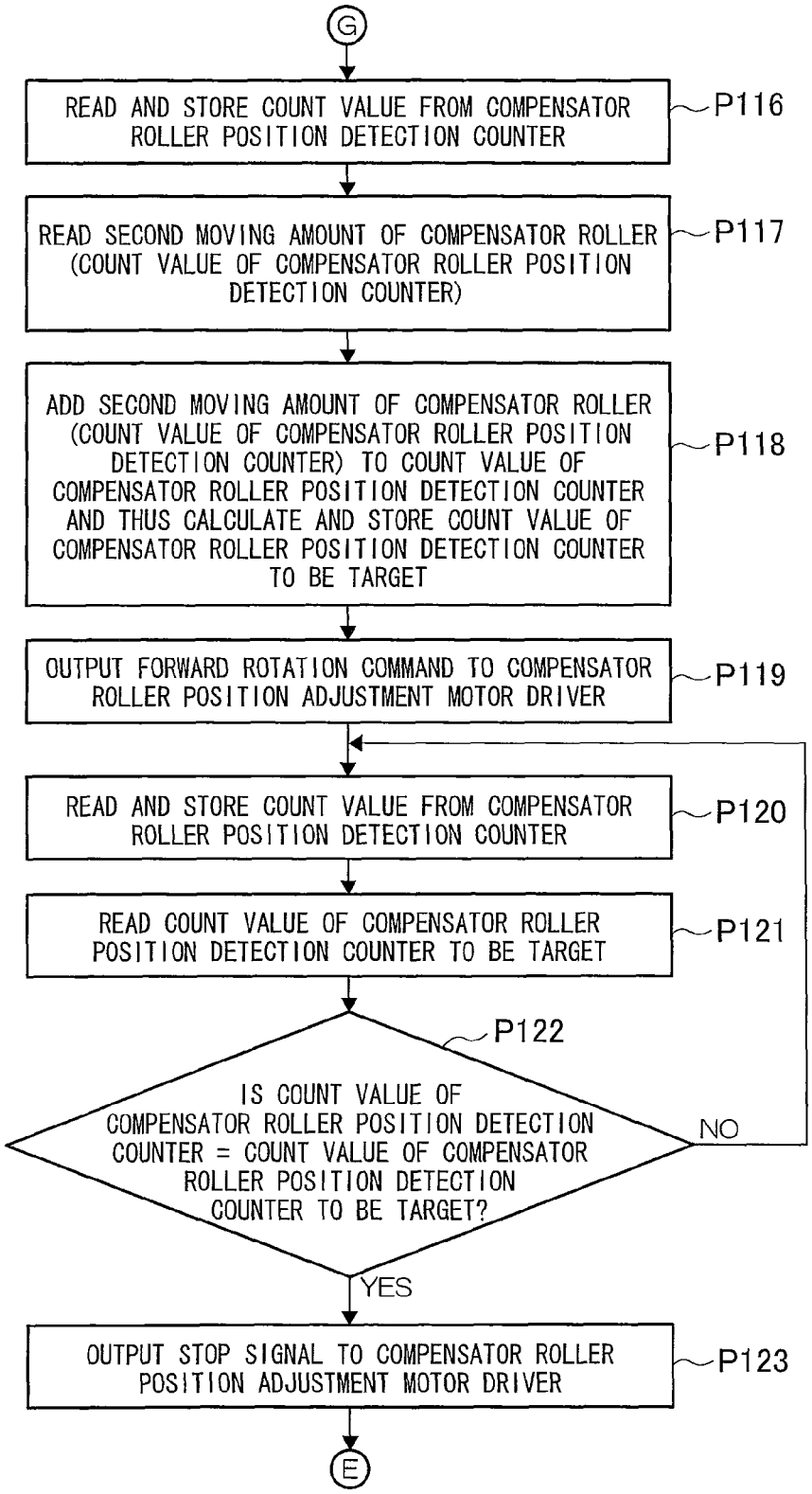
FIG. 7B is an operation flowchart of the cut-off register control device.
Figure 8:
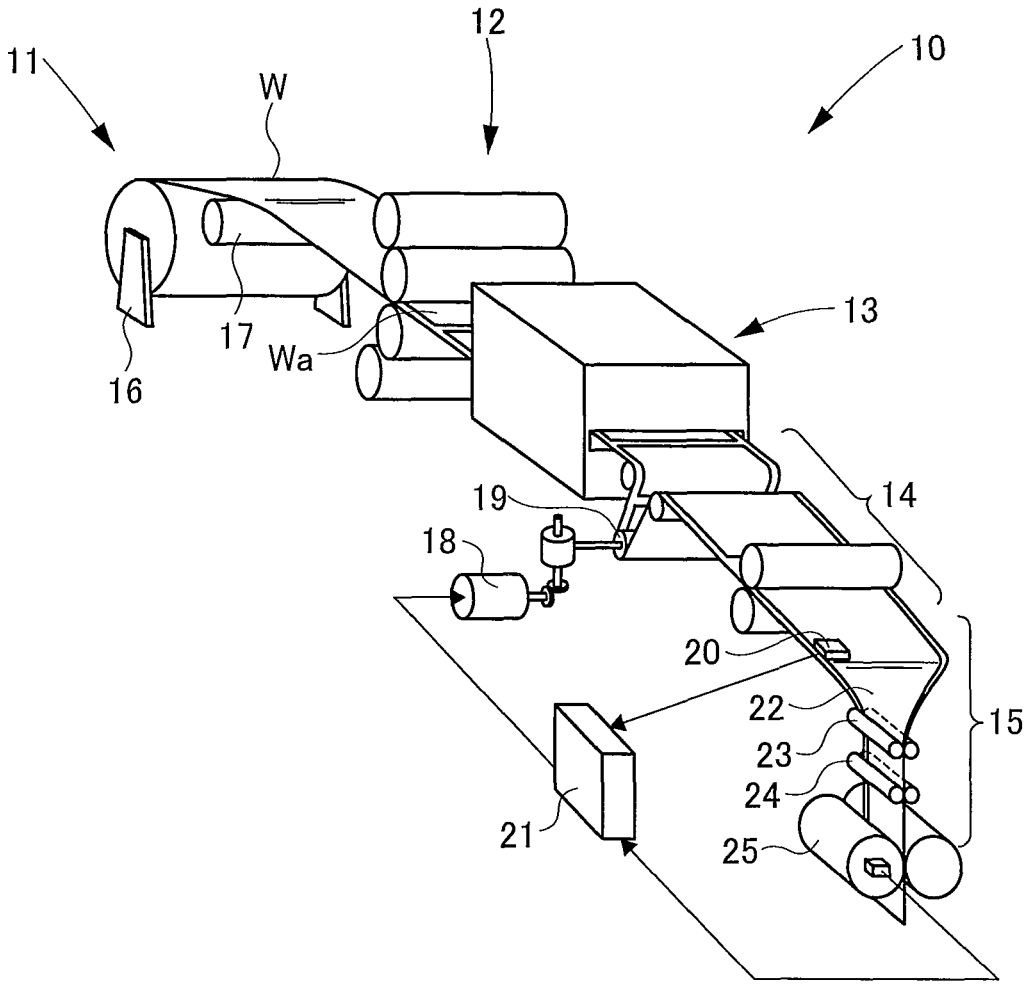
FIG. 8 is a perspective view showing a schematic configuration of a web rotary printing press.
Figure 9:
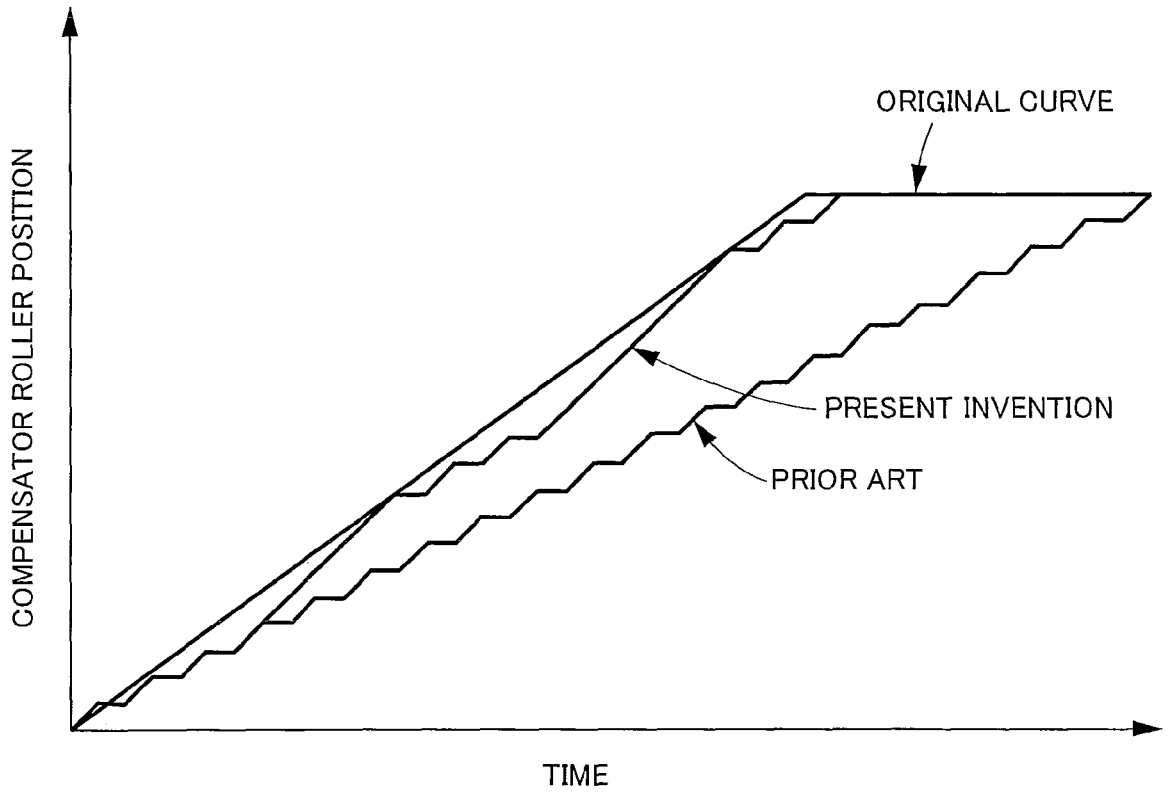
FIG. 9 is a graph showing a comparison between operation positions of a compensator roller.

FIG. 1A and FIG. 1B are block diagrams of a printing press control device for illustrating an embodiment of the present invention. FIG. 2A and FIG. 2B are block diagrams of a cut-off register control device. FIG. 3A to FIG. 3E are operation flowcharts of the printing press control device. FIG. 4A to FIG. 4E, FIG. 5A and FIG. 5B, FIG. 6A to FIG. 6D, as well as FIG. 7A and FIG. 7B are operation flowcharts of the cut-off register control device. FIG. 8 is a perspective view showing a schematic configuration of a web rotary printing press. FIG. 9 is a graph showing a comparison between operation positions of a compensator roller.

As shown in FIG. 8, a web rotary printing press 10 according to this embodiment is configured of a feeder (strip-shaped body supply device) 11, a printing unit 12, which is configured of multiple printing units (only single printing unit is illustrated, and illustration or the other printing units is omitted herein), a dryer 13, a web path unit 14, and a folder 15. A web W (strip-shaped body), which is installed on a stand 16 of the feeder 11, is fed to the printing unit 12 while being supported by a guide roller group 17. An image Wa is printed on the web W fed to the printing unit 12, and then, the web W is fed to the dryer 13. The web W fed to the dryer 13 is dried and then fed to the web path unit 14.

A compensator roller 19 and a detector 20 are installed in the web path unit 14. The compensator roller 19 is movable in an up and down direction by a compensator roller position adjustment motor 18. The detector 20 detects a register mark printed simultaneously with the image Wa, the register mark printed in a margin portion at a lateral side of a position corresponding to the image Wa of the web W.

Accordingly, the web W fed to the web path unit 14 is fed to the folder 15 while the position of the image Wa is adjusted in such a way that a cut-off cylinder (cutting apparatus) 25 to be described later cuts the web W in a center position of a space prepared for the image Wa printed on the web W and corresponding to a single sheet, by moving the compensator roller 19 in the up and down direction. During this process, the register mark printed on the web W is detected by the detector 20, and the detection signal is inputted to a control unit (cut-off register control device; control device) 21.

The web W fed to the folder 15 is folded by a triangular former 22 and then fed to nipping rollers 24 while being guided by guide rollers 23. The web W fed to the nipping rollers 24 is fed to cut-off cylinders 25 while being strongly pressurized from two sides, and then cut. During this process, the control unit 21 detects a rotation phase of the cut-off cylinder 25 and compares a rotate phase of the cut-off cylinder 25 to be used as a reference position in accordance with a circumferential adjustment position of a register mark in a printed material (reference rotation phase) with the rotation phase of the cut-off cylinder 25 when the register mark is actually detected by the detector 20. The control unit 21 adjusts the position of the compensator roller 19 in accordance with a result of the comparison in such a way that the cut-off cylinder 25 cuts the web W in the center position of the space prepared for the image Wa printed on the web W and corresponding to a single sheet. Note that, a description is given herein with an assumption that the control unit 21 is configured to detect the rotation phase of the cut-off cylinder 25, but the control unit 21 may be configured to detect a rotation phase of a drive motor 71 of the web rotary printing press 10, which is configured to drive the cut-off cylinder 25, and which is described later.

Moreover, in this embodiment, a printing press control device (control device) 50 to be described later and the control unit (cut-off register control device) 21 are configured to allow setting and storing of a wait time and a moving amount of the compensator roller in accordance with a paper quality and to forcibly move the compensator roller only by the set moving amount each time the set time elapses during a period from the start of speed acceleration until the end of speed acceleration.

As shown in FIG. 1A and FIG. 1B, the printing press control device 50 is configured by connecting input and output units 54 to 56, a first internal clock counter 57, and an interface 58 to a BUS (bus line) in addition to a CPU 51, a ROM 52, and a RAM 53.

In addition, the following memories are connected to the BUS: a printing speed storage memory M1; a first elapsed time storage memory (first storage means) M2; a compensator roller first moving amount storage memory (second storage means) M3; a second elapsed time storage memory (third storage means) M4; a compensator roller second moving amount storage memory (fourth storage means) M5; a current pre-set speed storage memory M6; a previous printing speed storage memory M7; a previous pre-set speed storage memory M8; a storage memory M9 for a count value of the first internal clock counter; a speed change time interval storage memory M10; a speed acceleration speed correction value storage memory M11; a speed deceleration speed correction value storage memory M12; and a corrected pre-set speed storage memory M13.

The following components are connected to the input and output unit 54: a printing start switch 59; a printing end switch 60; an input device 61 including a keyboard, various switches and buttons and the like; a display 62 including a CRT, a lamp, and the like; and an output device (floppy disk (registered trademark) drive, a printer, and the like) 63.

The following components are connected to the input and output unit 55: a printing speed setting unit 64; a first elapsed time setting unit 65; a compensator roller first moving amount setting unit 66; a second elapsed time setting unit 67; and a compensator roller second moving amount setting unit 68.

The drive motor 71 is connected to the input and output unit 56 via a D/A converter 69 and a drive motor driver 70. The drive motor driver 70 receives a clock pulse generated by a drive motor rotary encoder 72, which is additionally provided to the drive motor 71.

The printing unit (each printing unit) 12 of the web rotary printing press 10, and the cut-off register control device 21 are connected to the interface 58.

As shown in FIG. 2A and FIG. 2B, the control unit (cut-off register control device) 21 is configured by connecting input and output units 76 and 77, a second internal clock counter (elapsed time measurement means) 78, a third internal clock counter 79, and an interface 80 to a BUS (bus line) in addition to a CPU 73, a ROM 74, and a RAM 75.

In addition, the following memories are connected to the BUS: a first elapsed time storage memory (first storage means) M14; a compensator roller first moving amount storage memory (second storage means) M15; a second elapsed time storage memory (third storage means) M16; a compensator roller second moving amount storage memory (fourth storage means) M17; a storage memory M18 for a count value of a printing press rotation phase detection counter at start of detection; a storage memory M19 for a count value of the printing press rotation phase detection counter at end of detection; a storage memory M20 for a count value of the printing press rotation phase detection counter at register mark detection; a storage memory M21 for a reference count value of the printing press rotation phase detection counter; a storage memory M22 for a count value difference of the printing press rotation phase detection counter; and a storage memory M23 for an absolute value of a count value difference of the printing press rotation phase detection counter.

In addition, the following memories are connected to the BUS: a tolerance storage memory M24; a storage memory M25 for a conversion table for a count value difference of the printing press rotation phase detection counter–a count value of a compensator roller position detection counter; a storage memory M26 for a count value of the compensator roller position detection counter to be corrected; a storage memory M27 for a count value of the compensator roller position detection counter; a storage memory M28 for a count value of the compensator roller position detection counter to be a target; a storage memory M29 for a count value of the second internal clock counter; a first wait time storage memory M30; a second wait time storage memory M31; and a storage memory M32 for a count value of the third internal clock counter.

The following components are connected to the input and output unit 76: a detection start counter (down counter) 81; a detection end counter (down counter) 82; a printing press rotation phase storage latch 85; a start-up one-shot pulse generator circuit 86; a printing press rotation phase detection rotary encoder 83; a flip-flop circuit 84; a printing press rotation phase detection counter 87; an AND circuit 88; and the detector 20.

To put it specifically, the printing press rotation phase detection rotary encoder 83 outputs a zero pulse and resets the detection start counter (down counter) 81, the detection end counter (down counter) 82, and the printing press rotation phase detection counter 87. The count value of the printing press rotation phase detection counter 87 at start of register mark detection is set in the detection start counter (down counter) 81, and, the count value of the printing press rotation phase detection counter 87 at end of the register mark detection is set in the detection end counter (down counter) 82. The detection start counter (down counter) 81 performs subtraction on the value each time receiving a clock pulse, and when the value becomes zero, outputs a set signal to the flip-flop circuit 84 and starts register mark detection.

The signal outputted from the flip-flop circuit 84 is inputted to the AND circuit 88, and when a signal outputted from the detector 20 is also inputted to the AND circuit 88, a signal is outputted from the AND circuit 88. The signal outputted from the AND circuit 88 is inputted to the start-up one-shot pulse generator circuit 86.

Upon input of the signal from the AND circuit 88, the start-up one-shot pulse generator circuit 86 outputs a one-shot pulse to the printing press rotation phase storage latch 85. After input of the one-shot pulse, the printing press rotation phase storage latch 85 stores the count value of the printing press rotation phase detection counter 87 as a circumferential adjustment position of the register mark.

The detection end counter (down counter) 82 performs subtraction on the value each time receiving a clock pulse, and when the value becomes zero, outputs a reset signal to the flip-flop circuit 84 and ends the register mark detection.

The compensator roller position adjustment motor 18 is connected to the input and output unit 77 via a compensator roller position adjustment motor driver 89. In addition, a compensator roller position adjustment motor rotary encoder 92, which is additionally provided to the compensator roller position adjustment motor 18, is connected to the input and output unit 77 via a compensator roller position detection counter 91.

The printing press control device 50 is connected to the interface 80.

According to the configuration described above, the printing press control device 50 first operates in accordance with the operation flow shown in FIG. 3A to FIG. 3E.

To put it specifically, whether or not the printing start switch 59 is turned ON is determined in step P1. If yes, the operation moves to step P12 to be described later, and if no, whether or not there is input to the printing speed setting unit 64 is determined in step P2. If yes in step P2, a printing speed is read from the printing speed setting unit 64 and stored in the memory M1 in step P3, and then, the operation moves to step P4 to be described later, and if no in step P2, the operation directly moves to step P4.

Next, whether or not there is input to the first elapsed time setting unit 65 is determined in step P4 mentioned above. If yes, a first elapsed time is read from the first elapsed time setting unit 65, and a count value of the third internal clock counter 79, which corresponds to the first elapsed time, is calculated and stored in the first elapsed time storage memory M2 in step P5, and thereafter, the operation moves to step P6 to be described later. Meanwhile, if no in step P4, the operation directly moves to step P6.

Next, whether or not there is input to the compensator roller first moving amount setting unit 66 is determined in step P6 mentioned above. If yes, a first moving amount of the compensator roller 19 is read from the compensator roller first moving amount setting unit 66, and a count value of the compensator roller position detection counter 91, which corresponds to the first moving amount of the compensator roller 19, is calculated and stored in the compensator roller first moving amount storage memory M3 in step P7, and thereafter, the operation moves to step P8 to be described later. Meanwhile, if no in step P6, the operation directly moves to step P8.

Next, whether or not there is input to the second elapsed time setting unit 67 is determined in step P8 mentioned above. If yes, a second elapsed time is read from the second elapsed time setting unit 67, and a count value of the third internal clock counter 79, which corresponds to the second elapsed time, is calculated and stored in the second elapsed time storage memory M4 in step P9, and thereafter, the operation moves to step P10 to be described later. Meanwhile, if no in step P8, the operation directly moves to step P10.

Next, whether or not there is input to the compensator roller second moving amount setting unit 68 is determined in step P10 mentioned above. If yes, a second moving amount of the compensator roller 19 is read from the compensator roller second moving amount setting unit 68, and a count value of the compensator roller position detection counter 91, which corresponds to the second moving amount of the compensator roller 19, is calculated and stored in the compensator roller second moving amount storage memory M5 in step P11, and thereafter, the operation returns to step P1. Meanwhile, if no in step P10, the operation directly returns to step P1.

Next, after the printing speed is read from the memory M1 and stored in the current pre-set speed storage memory M6 in step P12 mentioned above, the current pre-set speed is outputted to the drive motor driver 70 via the D/A converter 69 in step P13. Subsequently, a printing start signal is outputted to each printing unit of the printing unit 12 in step P14.

Next, the following information is read in step P15: the first elapsed time (count value of the third internal clock counter 79); the first moving amount of the compensator roller 19 (count value of the compensator roller position detection counter 91); the second elapsed time (count value of the third internal clock counter 79); and the second moving amount of the compensator roller 19 (count value of the compensator roller position detection counter 91). Thereafter, the following information is sent to the cut-off register control device 21 in step P16: the first elapsed time (count value of the third internal clock counter 79); the first moving amount of the compensator roller 19 (count value of the compensator roller position detection counter 91); the second elapsed time (count value of the third internal clock counter 79); and the second moving amount of the compensator roller 19 (count value of the compensator roller position detection counter 91).

Next, whether or not there is input to the printing speed setting unit 64 is determined in step P17. If yes, the operation moves to step P24 to be described later, and if no, when the printing end switch 60 is turned ON in step P18, a control end signal is outputted to the cut-off register control device 21 in step P19.

Upon transmission of a reception signal for the control end signal from the cut-off register control device 21 in step P20, the outputting of the control end signal to the cut-off register control device 21 is stopped in step P21.

Next, after a printing end signal is outputted to each printing unit of the printing unit 12 in step P22, a stop signal is outputted to the drive motor driver 70 in step P23.

Next, after the printing speed is read from the memory M1 and stored in the previous printing speed storage memory M7 in step P24 mentioned above, the printing speed is read from the printing speed setting unit 64 and stored in the memory M1 in step P25.

Next, whether or not the printing speed>the previous printing speed is determined in step P26. If yes, a speed acceleration start signal is outputted to the cut-off register control device 21 in step P27. Thereafter, upon transmission of a reception signal for the speed acceleration start signal from the cut-off register control device 21 in step P28, the outputting of the speed acceleration start signal to the cut-off register control device 21 is stopped in step P29.

Next, after the previous printing speed is read from the memory M7 and stored in the previous pre-set speed storage memory M8 in step P30, a reset signal and an enable signal are outputted to the first internal clock counter 57 in step P31.

Next, the outputting of the reset signal to the first internal clock counter 57 is stopped in step P32, a count value is read from the first internal clock counter 57 and stored in the memory M9 in step P33.

Next, after a speed change time interval (count value of the first internal clock counter 57) is read from the memory M10 in step P34, whether or not the count value of the first internal clock counter=the speed change time interval (count value of the first internal clock counter 57) is determined in step P35.

Next, if yes in step P35 mentioned above, the previous pre-set speed is read from the memory M8 in step P36, and if no, the operation returns to step P33.

Next, after a speed correction value during speed acceleration is read from the memory M11 in step P37, the speed correction value during speed acceleration is added to the previous pre-set speed, and thus, a corrected pre-set speed is calculated and stored in the memory M13 in step P38.

Next, after the printing speed is read from the memory M1 in step P39, whether or not the corrected pre-set speed≥the printing speed is determined in step P40.

Next, if yes in step 240 mentioned above, a speed acceleration end signal is outputted to the cut-off register control device 21 in step P41. Thereafter, upon transmission of a reception signal for the speed acceleration end signal from the cut-off register control device 21 in step P42, the outputting of the speed acceleration end signal to the cut-off register control device 21 is stopped in step P43.

Next, after the printing speed is read from the memory M1 and stored in the current pre-set speed storage memory M6 in step P44, the current pre-set speed is read from the memory M6 in step P45. Subsequently, the current pre-set speed is outputted to the drive motor driver 70 via the D/A converter 69 in step P46, and then, the operation returns to step P17.

Next, if no in step P40 mentioned above, the corrected pre-set speed is read from the memory M13 and stored in the current pre-set speed storage memory M6 in step P47. Thereafter, the current pre-set speed is read from the memory M6 in step P48.

Next, after the current pre-set speed is outputted to the drive motor driver 70 via the D/A converter 69 in step P49, the current pre-set speed is stored in the previous pre-set speed storage memory M8 in step P50, and then, the operation returns to step P31.

Next, if no in step 226 mentioned above, after the previous printing speed is read from the memory M7 and stored in the previous pre-set speed storage memory M8 in step P51, a reset signal and an enable signal are outputted to the first internal clock counter 57 in step P52.

Next, after the outputting of the reset signal to the first internal clock counter 57 is stopped in step P53, the count value is read from the first internal clock counter 57 and stored in the memory M9 in step P54.

Next, after a speed change time interval (count value of the first internal clock counter 57) is read from the memory M10 in step P55, whether or not the count value of the first internal clock counter=the speed change time interval (count value of the first internal clock counter 57) is determined in step P56.

Next, if yes in step 256 mentioned above, the previous pre-set speed is read from the memory M8 in step P57, and if no, the operation returns to step P54.

Next, after a speed correction value during speed deceleration is read from the memory M12 in step P58, the speed correction value during speed deceleration is subtracted from the previous pre-set speed, and thus, a corrected pre-set speed is calculated and stored in the memory M13 in step P59.

Next, after the printing speed is read from the memory M1 in step P60, whether or not the corrected pre-set speed≤the printing speed is determined in step P61.

Next, if yes in step P61 mentioned above, after the printing speed is read from the memory M1 and stored in the current pre-set speed storage memory M6 in step P62, the current pre-set speed is read from the memory M6 in step P63. Subsequently, the current pre-set speed is outputted to the drive motor driver 70 via the D/A converter 69 in step P64, and then, the operation returns to step P17.

Next, if no in step P61 mentioned above, after the corrected pre-set speed is read from the memory M13 and stored in the current pre-set speed storage memory M6 in step P65, the current pre-set speed is read from the memory M6 in step P66.

Next, after the current pre-set speed is outputted to the drive motor driver 70 via the D/A converter 69 in step P67, the current pre-set speed is stored in the previous pre-set speed storage memory M8 in step P68, and then, the operation returns to step P52.

The speed control of the web rotary printing press 10 is carried out in accordance with the operation flow described above.

Next, the cut-off register control device 21 operates in accordance with the operation flow shown in FIG. 4A to FIG. 4E, FIG. 5A, FIG. 5B, FIG. 6A to FIG. 6D, and FIG. 7A and FIG. 7B.

To put it specifically, the printing press control device 50 sends the first elapsed time (count value of the third internal clock counter 79), the first moving amount of the compensator roller 19 (count value of the compensator roller position detection counter 91), the second elapsed time (count value of the third internal clock counter 79), and the second moving amount of the compensator roller 19 (count value of the compensator roller position detection counter 91) in step P1. Thereafter, the first elapsed time (count value of the third internal clock counter 79), the first moving amount of the compensator roller 19 (count value of the compensator roller position detection counter 91), the second elapsed time (count value of the third internal clock counter 79), and the second moving amount of the compensator roller 19 (count value of the compensator roller position detection counter 91) are received and then respectively stored in the memory M14, the memory M15, the memory M16, and the memory M17.

Next, after the count value of the printing press rotation phase detection counter 87 at start of detection is read from the memory M18 in step P3, the count value of the printing press rotation phase detection counter 87 at start of detection is outputted to and set in the detection start counter 81 in step P4.

Next, after the count value of the printing press rotation phase detection counter 87 at end of detection is read from the memory M19 in step P5, the count value of the printing press rotation phase detection counter 87 at end of detection is outputted to and set in the detection end counter 82 in step P6.

Next, whether or not a control end signal is sent from the printing press control device 50 is determined in step P7. If yes, a reception signal for the control end signal is sent to the printing press control device 50 in step P8, and if no, whether or not a speed acceleration start signal is sent from the printing press control device 50 is determined in step P9.

Next, if yes in step 9 mentioned above, a reception signal for the speed acceleration start signal is sent to the printing press control device 50 in step P10, and the operation moves to step P47 to be described later. Meanwhile, if no in step 9, whether or not the output of the detector 20 is turned ON is determined in step P11.

Next, if yes in step 11 mentioned above, the count value of the printing press rotation phase detection counter 87 is read from the printing press rotation phase storage latch 85 and stored in the storage memory M20 for the count value of the printing press rotation phase detection counter at register mark detection in step P12. Meanwhile, if no in step 11, the operation returns to step P7.

Next, after a reference count value of the printing press rotation phase detection counter 87 is read from the memory M21 in step P13, the count value of the printing press rotation phase detection counter 87 at register mark detection is subtracted from the reference count value of the printing press rotation phase detection counter 87, and thus, a count value difference of the printing press rotation phase detection counter 87 is calculated and stored in the memory M22 in step P14.

Next, an absolute value of the count value difference of the printing press rotation phase detection counter 87 is calculated from the count value difference of the printing press rotation phase detection counter 87 and stored in the memory M23 in step P15. Thereafter, a tolerance (count value of the counter) is read from the memory M24 in step P16.

Next, whether or not the absolute value of the count value difference of the printing press rotation phase detection counter 87>the tolerance (count value of the counter) is determined in step P17. If yes, a reset signal and an enable signal are outputted to the second internal clock counter 78 in step P18, and if no, the operation returns to step P7.

Next, after the outputting of the reset signal to the second internal clock counter 78 is stopped in step P19, the conversion table for the count value difference of the printing press rotation phase detection counter−the count value of the compensator roller position detection counter is read from the memory M25 in step P20.

Next, after the count value difference of the printing press rotation phase detection counter 87 is read from the memory M22 in step P21, a count value of the compensator roller position detection counter 91 to be corrected is found from the count value difference of the printing press rotation phase detection counter 87 by using the conversion table for the count value difference of the printing press rotation phase detection counter—the count value of the compensator roller position detection counter and stored in the memory M26 in step P22.

Next, after the count value is read from the compensator roller position detection counter 91 and stored in the memory M27 in step P23, the count value of the compensator roller position detection counter 91 to be corrected is added to the count value of the compensator roller position detection counter 91, and thus, a count value of the compensator roller position detection counter 91 to be a target is calculated and stored in the memory M28 in step P24.

Next, after the count value of the compensator roller position detection counter 91 is read from the memory M27 in step P25, whether or not the count value of the compensator roller position detection counter to be a target>the count value of the compensator roller position detection counter is determined in step P26.

Next, if yes in step P26 mentioned above, after a forward rotation command is outputted to the compensator roller position adjustment motor driver 89 in step P27, the count value is read from the compensator roller position detection counter 91 and stored in the memory M27 in step 228.

Next, after the count value of the compensator roller position detection counter 91 to be a target is read from the memory M28 in step P29, whether or not the count value of the compensator roller position detection counter=the count value of the compensator roller position detection counter to be a target is determined in step P30.

Next, if yes in step P30 mentioned above, after a stop signal is outputted to the compensator roller position adjustment motor driver 89 in step P31, a reset signal and an enable signal are outputted to the second internal clock counter 78 in step P32.

Next, after the cutputting of the reset signal to the second internal clock counter 78 is stopped in step 233, the count value is read from the second internal clock counter 78 and stored in the memory M29 in step P34.

Next, after a second wait time (count value of the internal clock counter) is read from the memory M31 in step P35, whether or not the count value of the second internal clock counter=the second wait time (count value of the internal clock counter) is determined in step P36. If yes, the operation returns to step 27, and if no, the operation returns to step P34.

Next, if no in step P30 mentioned above, after the count value is read from the second internal clock counter 78 and stored in the memory M29 in step P37, a first wait time (count value of the internal clock counter) is read from the memory M30 in step P38.

Next, whether or not the count value of the second internal clock counter=the first wait time (count value of the internal clock counter) is determined in step P39. If yes, the operation moves to step P31 mentioned above, and if no, the operation returns to step P28.

Next, if no in step P26 mentioned above, after a reverse rotation command is outputted to the compensator roller position adjustment motor driver 89 in step P40, the count value is read from the compensator roller position detection counter 91 and stored in the memory M27 in step P41.

Next, after the count value of the compensator roller position detection counter 91 to be a target is read from the memory M28 in step P42, whether or not the count value of the compensator roller position detection counter to be a target=the count value of the compensator roller position detection counter is determined in step P43.

Next, if yes in step P43 mentioned above, the operation moves to step P31 mentioned above. Meanwhile, if no, after the count value is read from the second internal clock counter 78 and stored in the memory M29 in step P44, the first wait time (count value of the internal clock counter) is read from the memory M30 in step P45.

Next, whether or not the count value of the second internal clock counter=the first wait time (count value of the internal clock counter) is determined in step P46. If yes, the operation moves to step P31 mentioned above, and if no, the operation returns to step P41.

According to the operation flow described above, even in a case where the adjustment amount of the compensator roller 19 is large, a correction is always made during the first wait time, i.e., a correction of only a constant moving amount is made once, and thereafter, the operation of the cut-off register control device 21 is stopped during the second wait time, i.e., during a period until the tension or the like becomes stable and the web W is transported between the compensator roller 19 and the detector 20. Moreover, even after the compensator roller 19 is moved to the target position, the operation of the cut-off register control device 21 is stopped during the second wait time, i.e., during the period until the tension or the like becomes stable and the web W is transported between the compensator roller 19 and the detector 20.

Next, after a reset signal and an enable signal are outputted to the third internal clock counter 79 in step P47 mentioned above, the outputting of the reset signal to the third internal clock counter 79 is stopped in step P48.

Next, after the count value is read from the third internal clock counter 79 and stored in the memory M32 in step P49, the first elapsed time (count value of the third internal clock counter 79) is read from the memory M14 in step P50.

Next, whether or not the count value of the third internal clock counter=the first elapsed time (count value of the third internal clock counter) is determined in step P51. If yes, the operation moves to step P108 to be described later, and if no, the second elapsed time (count value of the third internal clock counter 79) is read from the memory M16 in step P52.

Next, whether or not the count value of the third internal clock counter=the second elapsed time (count value of the third internal clock counter) is determined in step P53. If yes, the operation moves to step P116 to be described later, and if no, the operation moves to step P54.

Next, whether or not a control end signal is sent from the printing press control device 50 is determined in step P54 mentioned above. If yes, the operation returns to step P8, and if no, whether or not a speed acceleration end signal is sent from the printing press control device 50 is determined in step P55.

Next, if yes in step P55 mentioned above, a stop signal is outputted to the compensator roller position adjustment motor driver 89 in step 256, and then, the operation returns to step P7. Meanwhile, if no in step P55, whether or not the output of the detector 20 is turned ON is determined in step P57.

Next, if yes in step P57 mentioned above, the count value of the printing press rotation phase detection counter 87 is read from the printing press rotation phase storage latch 85 in step P58 and stored in the storage memory M20 for the count value of the printing press rotation phase detection counter at register mark detection in step P58. Meanwhile, if no in step P57, the operation returns to step P49.

Next, after a reference count value of the printing press rotation phase detection counter 87 is read from the memory M21 in step P59, the count value of the printing press rotation phase detection counter 87 at register mark detection is subtracted from the reference count value of the printing press rotation phase detection counter 87, and thus, a count value difference of the printing press rotation phase detection counter 87 is calculated and stored in the memory M22 in step P60.

Next, an absolute value of the count value difference of the printing press rotation phase detection counter 87 is calculated from the count value difference of the printing press rotation phase detection counter 87 and stored in the memory M23 in step P61. Thereafter, a tolerance (count value of the counter) is read from the memory M24 in step P62.

Next, whether or not the absolute value of the count value difference of the printing press rotation phase detection counter>the tolerance (count value of the counter) is determined in step P63. If yes, the operation moves to step P64, and if no, the operation returns to step P49.

Next, after a reset signal and an enable signal are outputted to the second internal clock counter 78 in step P64 mentioned above, the outputting of the reset signal to the second internal clock counter 78 is stopped in step P65.

Next, after the conversion table for the count value difference of the printing press rotation phase detection counter–the count value of the compensator roller position detection counter is read from the memory M25 in step P66, the count value difference of the printing press rotation phase detection counter 87 is read from the memory M22 in step P67.

Next, a count value of the compensator roller position detection counter 91 to be corrected is found from the count value difference of the printing press rotation phase detection counter 87 by using the conversion table for the count value difference of the printing press rotation phase detection counter—the count value of the compensator roller position detection counter and stored in the memory M26 in step P68. Thereafter, the count value is read from the compensator roller position detection counter 91 and stored in the memory M27 in step P69.

Next, the count value of the compensator roller position detection counter 91 to be corrected is added to the count value of the compensator roller position detection counter 91, and thus, a count value of the compensator roller position detection counter 91 to be a target is calculated and stored in the memory M28 in step P70. Thereafter, the count value of the compensator roller position detection counter 91 is read from the memory M27 in step P71.

Next, whether or not the count value of the compensator roller position detection counter to be a target>the count value of the compensator roller position detection counter is determined in step P72. If yes, a forward rotation command is outputted to the compensator roller position adjustment motor driver 89 in step P73, and then, the count value is read from the compensator roller position detection counter 91 and stored in the memory M27 in step 274.

Next, after the count value of the compensator roller position detection counter 91 to be a target is read from the memory M28 in step P75, whether or not the count value of the compensator roller position detection counter=the count value of the compensator roller position detection counter to be a target is determined in step P76.

Next, if yes in step P76 mentioned above, after a stop signal is outputted to the compensator roller position adjustment motor driver 89 in step P77, a reset signal and an enable signal are outputted to the second internal clock counter 78 in step P78.

Next, after the outputting of the reset signal to the second internal clock counter 78 is stopped in step P79, the count value is read from the second internal clock counter 78 and stored in the memory M29 in step P80.

Next, after a second wait time (count value of the internal clock counter) is read from the memory M31 in step P81, whether or not the count value of the second internal clock counter=the second wait time (count value of the internal clock counter) is determined in step P82. If yes, the operation returns to step P49, and if no, the count value is read from the third internal clock counter 79 and stored in the memory M32 in step P83.

Next, after the first elapsed time (count value of the third internal clock counter 79) is read from the memory M14 in step P84, whether or not the count value of the third internal clock counter=the first elapsed time (count value of the third internal clock counter) is determined in step P85.

Next, if yes in step P85 mentioned above, the operation moves to step P108 to be described later, and if no, the second elapsed time (count value of the third internal clock counter 79) is read from the memory M16 in step P86.

Next, whether or not the count value of the third internal clock counter=the second elapsed time (count value of the third internal clock counter 79) is determined in step P87. If yes, the operation moves to step P116 to be described later, and if no, the operation returns to step P80.

Next, if no in step P76 mentioned above, after the count value is read from the second internal clock counter 78 and stored in the memory M29 in step P88, the first wait time (count value of the internal clock counter) is read from the memory M30 in step P89.

Next, whether or not the count value of the second internal clock counter=the first wait time (count value of the internal clock counter) is determined in step P90. If yes, the operation moves to step P77 mentioned above, and if no, the count value is read from the third internal clock counter 79 and stored in the memory M32 in step P91.

Next, after the first elapsed time (count value of the third internal clock counter 79) is read from the memory M14 in step P92, whether or not the count value of the third internal clock counter=the first elapsed time (count value of the third internal clock counter) is determined in step P93.

Next, if yes in step P93 mentioned above, the operation moves to step P108, and if no, the second elapsed time (count value of the third internal clock counter 79) is read from the memory M16 in step P94.

Next, whether or not the count value of the third internal clock counter=the second elapsed time (count value of the third internal clock counter 79) is determined in step P95. If yes, the operation moves to step P116 to be described later, and if no, the operation returns to step P74.

Next, if no in step P72 mentioned above, a reverse rotation command is outputted to the compensator roller position adjustment motor driver 89 in step P96. Subsequently, the count value is read from the compensator roller position detection counter 91 and stored in the memory M27 in step P97.

Next, after the count value of the compensator roller position detection counter 91 to be a target is read from the memory M28 in step P98, whether or not the count value of the compensator roller position detection counter to be a target=the count value of the compensator roller position detection counter is determined in step P99.

Next, if yes in step P99 mentioned above, the operation moves to step P77 mentioned above, and if no, after the count value is read from the second internal clock counter 78 and stored in the memory M29 in step P100, the first wait time (count value of the internal clock counter) is read from the memory M30 in step P101.

Next, whether or not the count value of the second internal clock counter=the first wait time (count value of the internal clock counter) is determined in step P102. If yes, the operation moves to step P77 mentioned above, and if no, the count value is read from the third internal clock counter 79 and stored in the memory M32 in step P103.

Next, after the first elapsed time (count value of the third internal clock counter 79) is read from the memory M14 in step P104, whether or not the count value of the third internal clock counter=the first elapsed time (count value of the third internal clock counter) is determined in step P105.

Next, if yes in step P105 mentioned above, the operation moves to step P108 to be described later, and if no, the second elapsed time (count value of the third internal clock counter 79) is read from the memory M16 in step P106.

Next, whether or not the count value of the third internal clock counter=the second elapsed time (count value of the third internal clock counter 79) is determined in step P107. If yes, the operation moves to step P116 to be described later, and if no, the operation returns to step P97.

According to the operation flow described above, even in a case where the adjustment amount of the compensator roller 19 is large, a correction is always made during the first wait time, i.e., a correction of only a constant moving amount is made once, and thereafter, the operation of the cut-off register control device 21 is stopped during the second wait time, i.e., during a period until the tension or the like becomes stable and the web W is transported between the compensator roller 19 and the detector 20. Moreover, even after the compensator roller 19 is moved to the target position, the operation of the cut-off register control device 21 is stopped during the second wait time, i.e., during the period until the tension or the like becomes stable and the web W is transported between the compensator roller 19 and the detector 20.

Next, the count value is read from the compensator roller position detection counter 91 and stored in the memory M27 in step P108 to which the operation has moved from step P51, step P85, step P93, and step P105. Thereafter, the first moving amount of the compensator roller 19 (count value of the compensator roller position detection counter 91) is read from the memory M15 in step P109.

Next, the first moving amount of the compensator roller 19 (count value of the compensator roller position detection counter 91) is added to the count value of the compensator roller position detection counter 91, and thus, a count value of the compensator roller position detection counter 91 to be a target is calculated and stored in the memory M28 in step P110. Thereafter, a forward rotation command is outputted to the compensator roller position adjustment motor driver 89 in step P111.

Next, after the count value is read from the compensator roller position detection counter 91 and stored in the memory M27 in step P112, the count value of the compensator roller position detection counter 91 to be a target is read from the memory M28 in step P113.

Next, whether or not the count value of the compensator roller position detection counter=the count value of the compensator roller position detection counter to be a target is determined in step P114. If yes, a stop signal is outputted to the compensator roller position adjustment motor driver 89 in step P115, and the operation returns to step P49, and if no, the operation returns to step P112.

Next, the count value is read from the compensator roller position detection counter 91 and stored in the memory M27 in step P116 to which the operation has moved from step P53, step P87, step P95, and step P107 mentioned above. Thereafter, the second moving amount of the compensator roller 19 (count value of the compensator roller position detection counter 91) is read from the memory M17 in step P117.

Next, the second moving amount of the compensator roller 19 (count value of the compensator roller position detection counter 91) is added to the count value of the compensator roller position detection counter 91, and thus, a count value of the compensator roller position detection counter 91 to be a target is calculated and stored in the memory M28 in step P118. Thereafter, a forward rotation command is outputted to the compensator roller position adjustment motor driver 89 in step P119.

Next, after the count value is read from the compensator roller position detection counter 91 and stored in the memory M27 in step P120, the count value of the compensator roller position detection counter 91 to be a target is read from the memory M28 in step P121.

Next, whether or not the count value of the compensator roller position detection counter=the count value of the compensator roller position detection counter to be a target is determined in step P122. If yes, a stop signal is outputted to the compensator roller position adjustment motor driver 89 in step P123, and the operation returns to step P49, and if no, the operation returns to step P120.

Accordingly, upon transmission of a speed acceleration start signal from the printing press control device 50 in step P9, the operation of the third internal clock counter 79 is started in step P47 and step P48. Then, the whether or not the count value of the third internal clock counter 79 becomes the first or second elapsed time is determined in step P51 and step P53 in the loop of step P49 to step P55→step P57, in step P93 and step P95 in the loop of step P74 to step P76→step P88 to step P95, in step P105 and step P107 in the loop of step P97 to step P107, and in step P85 and step P87 in the loop of step P80 to step P87. Then, in a case where the count value of the third internal clock counter 79 becomes the first or second elapsed time, the compensator roller 19 is forcibly moved by the first or second moving amount even if the compensator roller 19 is in moving state due to the first wait time or in stopped state due to the second wait time of the compensator roller 19 by normal register mark detection. To put it differently, according to the operation flow described above, the forcible movement control of the compensator roller 19 is carried out during the period from the start of speed acceleration of the web rotary printing press 10 until the end of speed acceleration thereof.

As described above, in this embodiment, it is made possible to set and store the wait time and the moving amount of the compensator roller 19 in accordance with a paper quality, and the compensator roller 19 is configured to be forcibly moved in two stages by the set moving amount each time the set time elapses during a period from the start of speed acceleration until the end of speed acceleration. Thus, the position of the compensator roller 19 can be adjusted by a larger amount taking into account the amount of time lag.

Accordingly, as shown in FIG. 9, it is possible to achieve a reduction in the time required until the web becomes ready to be cut in an accurate position through adjustment by the cut-off register control device 21. Accordingly, it is made possible to suppress generation of waste paper.

Note that, the present invention is not limited to the embodiment described above, and various medications without departing from the gist of the present invention, such as forcibly moving the compensator roller 19 in three or more stages are possible as a matter of course.

INDUSTRIAL APPLICABILITY

The strip-shaped body cutting position adjustment method and system for a cutting apparatus, according to the present invention can be applied not only to a web rotary printing press but also to other machines each configured to cut a strip-shaped body such as a film, for benefit.

REFERENCE SIGNS LIST

10 WEB ROTARY PRINTING PRESS
11 FEEDER
12 PRINTING UNIT
13 DRYER
14 WEB PATH UNIT
15 FOLDER
16 STAND
17 GUIDE ROLLER GROUP
18 COMPENSATOR ROLLER POSITION ADJUSTMENT MOTOR
19 COMPENSATOR ROLLER
20 DETECTOR
21 CONTROL UNIT (CUT-OFF REGISTER CONTROL DEVICE)
22 TRIANGULAR FORMER
23 GUIDE ROLLER
24 NIPPING ROLLER
25 CUT-OFF CYLINDER
50 PRINTING PRESS CONTROL DEVICE
W WEB
Wa IMAGE

The invention claimed is:

1. A strip-shaped body cutting position adjustment method for a cutting apparatus, the method used in a system comprising:

a strip-shaped body feeding apparatus configured to feed a strip-shaped body;

a cutting apparatus configured to cut the fed strip-shaped body;

a compensator roller which is provided in a strip-shaped body transport path extending from the strip-shaped body feeding apparatus to the cutting apparatus and which is supported movably for changing a length of the strip-shaped body transport path extending from the strip-shaped body feeding apparatus to the cutting apparatus;

a register mark printed on the strip-shaped body;

a detector which is provided in such a manner as to face the strip-shaped body transported from the compensator roller to the cutting apparatus, and which is configured to detect the register mark; and a control device that receives an output from the detector, the method comprising the steps of:

finding, by the control device, a rotation phase of the cutting apparatus when the detector detects the register mark;

finding, by the control device, a rotation phase difference by comparing, by the control device, the found rotation phase of the cutting apparatus at the time of detection of the register mark with a previously stored reference rotation phase; and moving the compensator roller in accordance with the found rotation phase difference, the system further comprising:

first storage means for storing a first reference elapsed time from start of speed acceleration of the cutting apparatus at which movement of the compensator roller is started to an end of the speed acceleration;

second storage means for storing a first moving amount of the compensator roller; and elapsed time measurement means for measuring time from the start of speed acceleration of the cutting apparatus, the method further comprising the steps of:

comparing, by the control device, the elapsed time measured by the elapsed time measurement means with the first reference elapsed time stored in the first storage means; and moving the compensator roller by the first moving amount stored in the second storage means, when the elapsed time measured by the elapsed time measurement means becomes equal to the first reference elapsed time.

2. The strip-shaped body cutting position adjustment method for a cutting apparatus, according to claim 1, the system further comprising:

third storage means for storing a second reference elapsed time from start of speed acceleration of the cutting apparatus at which movement of the compensator roller is started; and fourth storage means for storing a second moving amount of the compensator roller, and the method further comprising the steps of:

comparing, by the control device, the elapsed time measured by the elapsed time measurement means with the second reference elapsed time stored in the third storage means; and moving the compensator roller by the second moving amount stored in the fourth storage means, when the elapsed time measured by the elapsed time measurement means becomes equal to the second reference elapsed time.

3. A strip-shaped body cutting position adjustment system for a cutting apparatus, the system comprising:

a strip-shaped body feeding apparatus configured to feed a strip-shaped body;

a cutting apparatus configured to cut the fed strip-shaped body;

a compensator roller which is provided in a strip-shaped body transport path extending from the strip-shaped body feeding apparatus to the cutting apparatus and which is supported movably for changing a length of the strip-shaped body transport path extending from the strip-shaped body feeding apparatus to the cutting apparatus;

a register mark printed on the strip-shaped body;

a detector which is provided in such a manner as to face the strip-shaped body transported from the compensator roller to the cutting apparatus, and which is configured to detect the register mark; and a control unit configured to find a rotation phase of the cutting apparatus when the detector detects the register mark, then to find a rotation phase difference by comparing the found rotation phase of the cutting apparatus at the time of detection of the register mark with a previously stored reference rotation phase, and to move the compensator roller in accordance with the found rotation phase difference, the system further comprising:

first storage means for storing a first reference elapsed time from start of speed acceleration of the cutting apparatus at which movement of the compensator roller is started to an end of the speed acceleration;

second storage means for storing a first moving amount of the compensator roller; and elapsed time measurement means for measuring time from the start of speed acceleration of the cutting apparatus, wherein the control unit compares the elapsed time measured by the elapsed time measurement means with the first reference elapsed time stored in the first storage means, and moves the compensator roller by the first moving amount stored in the second storage means, when the elapsed time measured by the elapsed time measurement means becomes equal to the first reference elapsed time.

4. The strip-shaped body cutting position adjustment system for a cutting apparatus, according to claim 3, the system further comprising:

third storage means for storing a second reference elapsed time from start of speed acceleration of the cutting apparatus at which movement of the compensator roller is started; and fourth storage means for storing a second moving amount of the compensator roller, wherein the control unit compares the elapsed time measured by the elapsed time measurement means with the second reference elapsed time stored in the third storage means, and moves the compensator roller by the second moving amount stored in the fourth storage means, when the elapsed time measured by the elapsed time measurement means becomes equal to the second reference elapsed time.

* * * * *